US012595086B2

(12) United States Patent
Iimori et al.

(10) Patent No.: US 12,595,086 B2
(45) Date of Patent: Apr. 7, 2026

(54) PACKAGING DEVICE, WOUND BODY, CORE TUBE, METHOD FOR MANUFACTURING WOUND BODY, AND WOUND MATERIAL

(71) Applicant: TAKAZONO CORPORATION, Kadoma (JP)

(72) Inventors: Kazuo Iimori, Hirakata (JP); Yoshihiro Yamamoto, Hirakata (JP)

(73) Assignee: TAKAZONO CORPORATION, Osaka (JP)

( * ) Notice: Subject to any disclaimer, the term of this patent is extended or adjusted under 35 U.S.C. 154(b) by 0 days.

(21) Appl. No.: 19/094,690

(22) Filed: Mar. 28, 2025

(65) Prior Publication Data

US 2025/0250051 A1 Aug. 7, 2025

Related U.S. Application Data

(63) Continuation of application No. 18/403,802, filed on Jan. 4, 2024, now Pat. No. 12,297,001, which is a (Continued)

(30) Foreign Application Priority Data

Mar. 8, 2019 (JP) ..... 2019-042833

(51) Int. Cl.
*B65B 57/08* (2006.01)
*B65B 9/08* (2012.01)
*B65B 41/12* (2006.01)

(52) U.S. Cl.
CPC ..... *B65B 57/08* (2013.01); *B65B 9/08* (2013.01); *B65B 41/12* (2013.01)

(58) Field of Classification Search
CPC ..... B65B 41/12; B65B 9/08; B65B 57/08; B65B 57/02; B65H 2408/2171;
(Continued)

(56) References Cited

U.S. PATENT DOCUMENTS 11,866,214 B2 1/2024 Timori et al.
2003/0188511 A1 10/2003 Iwamura et al.
(Continued)

FOREIGN PATENT DOCUMENTS

CN 1178765 A 4/1998
CN 1269318 A 10/2000
(Continued)

OTHER PUBLICATIONS

International Search Report dated Apr. 28, 2020, issued in counterpart application No. PCT/JP2020/006741 (2 pages).
(Continued)

*Primary Examiner* — Himchan Song
(74) *Attorney, Agent, or Firm* — WHDA, LLP

(57) ABSTRACT

Time required for initial operation and operation immediately after wound body replacement is shortened. A packaging device packages an object to be packaged using a wound body. An elongated sheet-shaped packaging material is wound into the wound body. The wound body includes a recording medium that stores information. The information recorded in the recording medium includes remaining amount information indicating a remaining amount of the packaging material in the wound body. The packaging device includes a drive unit that generates driving force in order to rotate the wound body, an information reader that reads the remaining amount information stored in the recording medium, and a controller that controls the packaging device. The controller sets a rotation speed of the wound body based on the remaining amount information read by the information reader.

3 Claims, 30 Drawing Sheets

Related U.S. Application Data continuation of application No. 17/435,794, filed as application No. PCT/JP2020/006741 on Feb. 20, 2020, now Pat. No. 11,866,214.

(58) Field of Classification Search

CPC ..... B65H 2511/114; B65H 2511/14; B65H 2701/1944; B65H 23/005; B65H 23/185; B65H 23/198

See application file for complete search history.

(56) References Cited

U.S. PATENT DOCUMENTS

| | | | | |
|---|---|---|---|---|
| 2005/0198920 | A1 | 9/2005 | Nakagawa et al. | |
| 2009/0173046 | A1* | 7/2009 | Nakagawa | B65B 41/18 53/450 |
| 2016/0059983 | A1 | 3/2016 | Yoshina et al. | |
| 2017/0121142 | A1* | 5/2017 | Hagi | B41J 15/04 |
| 2017/0137157 | A1* | 5/2017 | Irwin | B65B 59/001 |
| 2018/0042181 | A1* | 2/2018 | Chapon | A01F 15/14 |
| 2018/0282096 | A1* | 10/2018 | Wada | B41J 15/16 |
| 2019/0380359 | A1* | 12/2019 | Irwin | A23G 9/22 |
| 2020/0346885 | A1* | 11/2020 | Tsujimoto | B29C 66/43 |
| 2020/0377244 | A1* | 12/2020 | West | B65B 11/025 |
| 2021/0229849 | A1* | 7/2021 | Sabato | B65B 9/04 |

FOREIGN PATENT DOCUMENTS

| | | | |
|---|---|---|---|
| CN | 1449966 | A | 10/2003 |
| CN | 105228573 | A | 1/2016 |
| EP | 0831048 | A1 | 3/1998 |
| EP | 2390193 | A1 | 11/2011 |
| JP | 2004-248752 | A | 9/2004 |
| JP | 2005-119802 | A | 5/2005 |
| JP | 2005-219406 | A | 8/2005 |
| JP | 2005-230242 | A | 9/2005 |
| JP | 2005-343699 | A | 12/2005 |
| JP | 2012-171641 | A | 9/2012 |
| JP | 2015-077797 | A | 4/2015 |
| JP | 5787045 | B2 | 9/2015 |
| JP | 2016-185420 | A | 10/2016 |
| JP | 6083455 | B2 | 2/2017 |
| JP | 6094651 | B2 | 3/2017 |
| JP | 2018-043875 | A | 3/2018 |
| JP | 2018-118778 | A | 8/2018 |
| KP | 10-1668952 | B1 | 10/2016 |
| TW | 201438708 | A | 10/2014 |
| WO | 2001/000491 | A1 | 1/2001 |
| WO | 2004/014733 | A1 | 2/2004 |

OTHER PUBLICATIONS

Notice of Reasons for Refusal dated May 7, 2019, issued in counterpart Japanese Patent Application No. 2019-045177, w/English translation (9 pages).

Office Action dated Mar. 1, 2022, issued in counterpart JP Application No. 2020-066094, with English Translation. (39 pages).

Office Action dated Aug. 17, 2022, issued in CN applilcation No. 202080019558.8. with English translation. (21 pages).

Office Action dated Jan. 5, 2023, issued in counterpart CN application No. 202080019558.8, with English translation. (6 pages).

Office Action dated Jan. 31, 2023, issued in counterpart TW application No. 109107208, with English partial translation. (5 pages).

Office Action dated Feb. 18, 2025, issued in counterpart JP application No. 2024-134923, with English translation (4 pages).

Decision to Grant a Patent dated Jun. 10, 2025, issued in counterpart JP Application No. 2024-134923 with English translation. (5 pages).

* cited by examiner

PACKAGING DEVICE, WOUND BODY, CORE TUBE, METHOD FOR MANUFACTURING WOUND BODY, AND WOUND MATERIAL

CROSS-REFERENCE TO RELATED APPLICATION

This application is a continuation application of U.S. patent application Ser. No. 18/403,802 filed on Jan. 4, 2024, which is a continuation application of Ser. No. 17/435,794 filed on Sep. 2, 2021, now U.S. Pat. No. 11,866,214, which is a national stage application filed under 35 USC 371 of International Application No. PCT/JP2020/006741 filed Feb. 20, 2020, which is based on and claims the benefit of priority from the prior Japanese Patent Application No. 2019-042833 filed on Mar. 8, 2019, the entire contents of which are incorporated herein by reference.

TECHNICAL FIELD

The present disclosure relates to a packaging device packaging an object to be packaged in a packaging material, a wound body used in the packaging device, a core tube used in the wound body, a method for manufacturing the wound body, and a wound material used in the method for manufacturing the wound body.

BACKGROUND ART

Conventionally, a packaging device sequentially packages an object to be packaged with a packaging material unwound from a wound body. The wound body is configured by winding an elongated sheet-shaped packaging material. Japanese Patent Laying-Open No. 2018-043875 (PTL 1) and Japanese Patent Laying-Open No. 2018-118778 (PTL 2) disclose a configuration detecting a remaining amount of the packaging material in the wound body.

CITATION LIST

Patent Literature

PTL 1: Japanese Patent Laying-Open No. 2018-043875
PTL 2: Japanese Patent Laying-Open No. 2018-118778

SUMMARY OF INVENTION

Technical Problem

In the device described in the above documents, when the remaining amount of the packaging material is not known, a rotation speed of the wound body is set to a minimum speed to unwind and wind the packaging material from the viewpoint of reliably preventing step out. A remaining amount determination result of the packaging material does not exist at initial operation immediately after activation of the packaging device and at operation immediately after replacement of the wound body, so that processing of unwinding and winding the packaging material at the minimum speed to determine the remaining amount of the packaging material is performed. Therefore, it takes time to start packaging.

The present disclosure provides a packaging device capable of reducing the time required for the initial operation and the operation immediately after the replacement of the wound body.

Solution to Problem

According to the present disclosure, a packaging device that packages an object to be packaged using a wound body is provided. An elongated sheet-shaped packaging material is wound into the wound body. The wound body includes a recording medium that stores information. The information recorded in the recording medium includes remaining amount information indicating a remaining amount of the packaging material in the wound body. The packaging device includes a drive unit that generates driving force in order to rotate the wound body, an information reader that reads the remaining amount information stored in the recording medium, and a controller that controls the packaging device. The controller sets a rotation speed of the wound body based on the remaining amount information read by the information reader.

The packaging device further includes a conveyance unit and a tension applying unit. The conveyance unit conveys the packaging material unwound from the wound body along a conveyance path. The tension applying unit includes a displacement member that is displaceable in a direction intersecting the conveyance path. The tension applying unit applies tension to the packaging material when the displacement member presses the packaging material. A fixed position of the displacement member is set. The controller drives the drive unit so as to rotate the wound body at a rotation speed set based on the remaining amount information to move the displacement member to the fixed position when the packaging device is powered on or when the wound body is mounted on the packaging device.

The packaging device further includes a position detector that detects that the displacement member is at the fixed position. The controller unwinds the packaging material from the wound body until the position detector detects the displacement member to move the displacement member to the fixed position. The controller may wind the packaging material onto the wound body until the position detector that detects the displacement member no longer detects the displacement member, and then the controller may unwind the packaging material from the wound body until the position detector detects the displacement member to move the displacement member to the fixed position.

The packaging device further includes a position detector that detects that the displacement member is at the fixed position. The controller winds the packaging material onto the wound body until the position detector detects the displacement member to move the displacement member to the fixed position.

In the packaging device, the information reader is configured to be able to write the remaining amount information in the recording medium. The controller measures a drive amount of the drive unit while the drive unit drives the wound body, and the controller determines the remaining amount of the packaging material in the wound body based on the measurement result. The controller causes the information reader to write the determination result of the remaining amount of the packaging material as remaining amount information in the recording medium.

In the packaging device, a plurality of stages are set in the remaining amount of the packaging material. When it is determined that the remaining amount of the packaging material is smaller than a remaining amount at a current stage, the controller causes the information reader to write the remaining amount reduced by one stage in the recording medium as the remaining amount information.

According to the present disclosure, a wound body used in the packaging device in any one of the above aspects is provided. The wound body includes a core tube and an elongated sheet-shaped packaging material wound around the core tube. The core tube includes a recording medium that stores information, and the information includes remaining amount information indicating a remaining amount of the packaging material in the wound body.

According to the present disclosure, a wound body used in the packaging device in any one of the above aspects is provided. The wound body includes a core tube, an elongated sheet-shaped packaging material wound around the core tube, and a recording medium that stores information. The information includes remaining amount information indicating a remaining amount of the packaging material in the wound body.

According to the present disclosure, a core tube used in the wound body is provided. The wound body includes the core tube and an elongated sheet-shaped packaging material wound around the core tube. The wound body includes a recording medium that stores information. The information recorded in the recording medium includes remaining amount information indicating a remaining amount of the packaging material in the wound body.

According to the present disclosure, a method for manufacturing a wound body used in the packaging device in any one of the above aspects is provided. The wound body includes a core tube and an elongated sheet-shaped packaging material wound around the core tube. The manufacturing method includes preparing the core tube and winding the packaging material around the core tube.

In the manufacturing method, the wound body includes a recording medium that stores information. The information includes remaining amount information indicating a remaining amount of the packaging material in the wound body. The manufacturing method further includes writing an amount of the packaging material wound around the core tube in the winding in the recording medium as remaining amount information.

According to the present disclosure, a method for manufacturing a wound body used in the packaging device in any one of the above aspects is provided. The manufacturing method includes preparing a core tube, preparing a wound material obtained by winding an elongated sheet-shaped packaging material around a hollow cylindrical portion, and inserting the core tube into the cylindrical portion to integrate the wound material and the core tube.

In the manufacturing method, the wound body includes a recording medium that stores information. The information includes remaining amount information indicating a remaining amount of the packaging material in the wound body. The manufacturing method further includes writing an amount of the packaging material wound around the cylindrical portion in the recording medium as the remaining amount information.

According to the present disclosure, a wound material used in the manufacturing method is provided, the wound material being obtained by winding the elongated sheet-shaped packaging material around the hollow cylindrical portion.

Advantageous Effects of Invention

According to the packaging device of the present disclosure, the time required for the initial operation and the operation immediately after the replacement of the wound body can be shortened.

DESCRIPTION OF EMBODIMENTS

Figure 1:
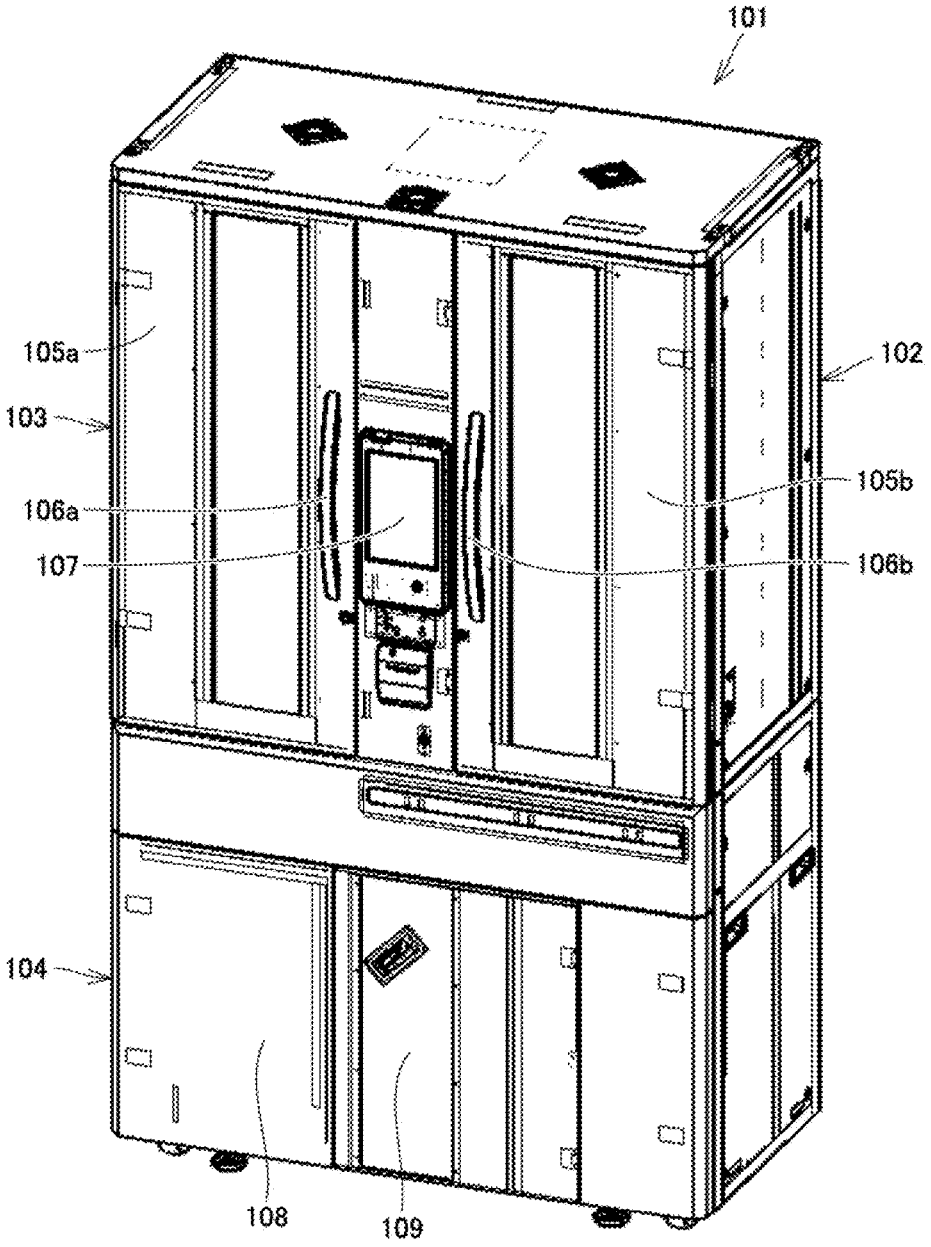
FIG. 1 is a perspective view illustrating an appearance of a drug supply device.

Hereinafter, an embodiment of the present invention will be described with reference to the drawings. In the following drawings, the same or corresponding component is designated by the same reference numeral, and the overlapping description will be omitted.

FIG. 1 is a perspective view illustrating an appearance of a drug supply device 101. As illustrated in FIG. 1, drug supply device 101 includes a housing 102 constituting an outer shell of drug supply device 101. Housing 102 includes an upper housing 103 and a lower housing 104. A drug accommodation and dispensing device that discharges each drug from a plurality of drug containers is accommodated in upper housing 103. A packaging device that packages the drug in a packaging material is accommodated in lower housing 104.

Doors 105*a*, 105*b* are attached to a front surface of upper housing 103. Door 105*a* includes a handle 106*a*, and door 105*b* includes a handle 106*b*. A user who uses drug supply device 101 can open and close door 105*a* by holding handle 106*a*, and open and close door 105*b* by holding handle 106*b*. An operation unit 107 is provided on the front surface of upper housing 103. Operation unit 107 may include a display having a touch panel function, or include a physical button on an operation panel.

Doors 108, 109 are provided on the front surface of lower housing 104. Doors 108, 109 are configured to be openable. The user who uses drug supply device 101 can open doors 108, 109 and take out a package containing the drug from an inside of lower housing 104. An opening may be formed in doors 108, 109, and the package containing the drug may be taken out from the opening.

Figure 2:
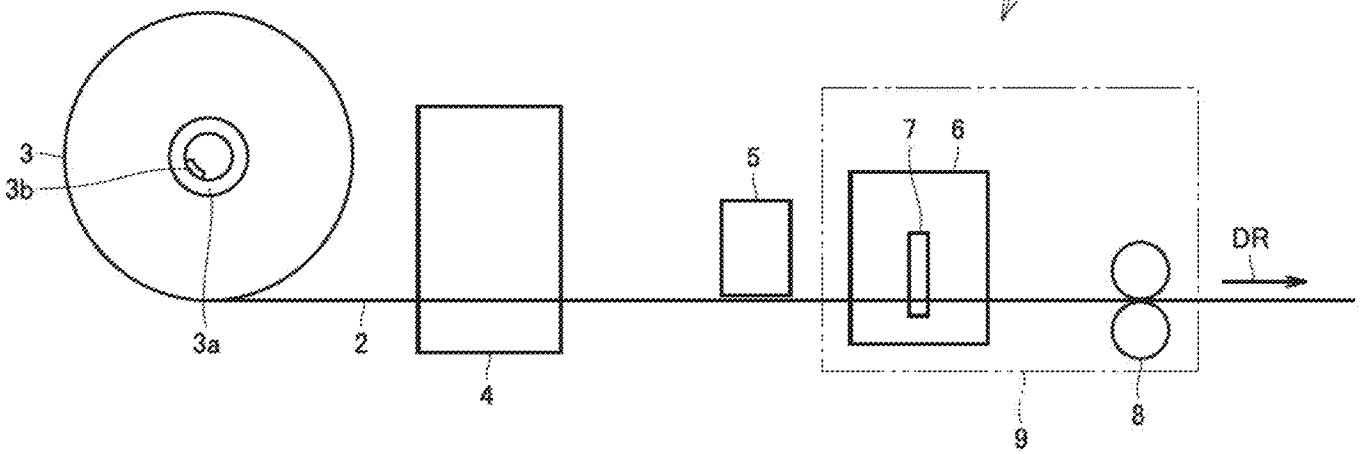
FIG. 2 is a schematic configuration diagram of a packaging device according to an embodiment.

FIG. 2 is a schematic configuration diagram illustrating a packaging device 1 of the embodiment. Packaging device 1 is used for packaging an object to be packaged. The object to be packaged is the drug, specifically a solid drug. Examples of the solid drug include a tablet, a pill, and a capsule. The solid drug may be a powder and a granule. The object to be packaged is not limited to the solid drug. The object to be packaged may be a semi-solid drug or a liquid drug.

Packaging device 1 is a drug packaging device that packages the drug based on a prescription. The prescription is delivered by a doctor to a patient. Patient information and drug information are described in the prescription. The patient information includes a name and an age of the patient. The drug information includes a drug name, an amount, a usage, and a dose. Packaging device 1 is used to package the drug for each dose based on such a prescription.

Packaging device 1 includes a packaging material conveyance unit 8. Packaging material conveyance unit 8 applies driving force to a packaging material 2 to convey packaging material 2. Packaging material 2 has an elongated sheet shape. Packaging material 2 is conveyed in a longitudinal direction of packaging material 2. Packaging material 2 is unwound from a wound body 3. Wound body 3 is formed by winding packaging material 2 around a core tube 3*a* that is a hollow tube body to form a roll. An arrow in FIG. 2 indicates a conveyance direction DR of packaging material 2. Hereinafter, conveyance direction DR of packaging material 2 is simply referred to as "conveyance direction DR".

A recording medium 3*b* is provided in core tube 3*a*. Recording medium 3*b* may be provided directly or indirectly with respect to core tube 3*a*. For example, recording medium 3*b* may be attached to a winding start portion of packaging material 2. Recording medium 3*b* includes a nonvolatile memory and stores information. Information stored in recording medium 3*b* includes remaining amount information indicating a remaining amount of packaging material 2 wound around core tube 3*a*. Recording medium 3*b* may also store other information such as paper quality of packaging material 2. For example, recording medium 3*b* may be an IC tag (radio frequency identification (RFID) tag).

Core tube 3*a* and recording medium 3*b* can be reused. Core tube 3*a* and recording medium 3*b* may be reused after previously-wound packaging material 2 is used up.

During manufacturing of wound body 3, a lot number, a manufacturing date, customer information, paper quality information of packaging material 2, remaining amount information, and the like may be recorded on recording medium 3*b*. In the case of new wound body 3, the remaining amount of packaging material 2 wound around core tube 3*a* in new wound body 3 is recorded as the remaining amount information. After wound body 3 is mounted on packaging device 1, a usage start date and time, environmental information, and the like may be added to recording medium 3*b*.

Packaging device 1 further includes a printing unit 4, a supply unit 5, and an accommodation-part formation unit 6. Printing unit 4, supply unit 5, and accommodation-part formation unit 6 are arranged in this order from an upstream side (side close to wound body 3) toward a downstream side (side away from wound body 3) in conveyance direction DR. Printing unit 4 prints predetermined information on packaging material 2 conveyed by packaging material conveyance unit 8. The predetermined information is information related to the drug. Supply unit 5 supplies the drug to packaging material 2 conveyed by packaging material conveyance unit 8. The drug is supplied for each dose based on the prescription. Accommodation-part formation unit 6 forms an accommodation part using packaging material 2 conveyed by packaging material conveyance unit 8. The drug is stored in the accommodation part. After the drug is supplied from supply unit 5, accommodation-part formation unit 6 thermally fuses packaging material 2 to form the package in which the drug is accommodated.

Packaging device 1 further includes a perforation forming unit 7. Perforation forming unit 7 is provided in accommodation-part formation unit 6. Perforation forming unit 7 forms a perforation extending in a direction orthogonal to conveyance direction DR in packaging material 2 conveyed by packaging material conveyance unit 8. The perforation is formed by continuously arranging a plurality of pores in a short direction of packaging material 2.

In such packaging device 1, accommodation-part formation unit 6, perforation forming unit 7, and packaging material conveyance unit 8 constitute a packaging unit 9. In packaging unit 9, the drug that is the object to be packaged is sequentially packaged using packaging material 2 unwound from wound body 3.

Figure 3:
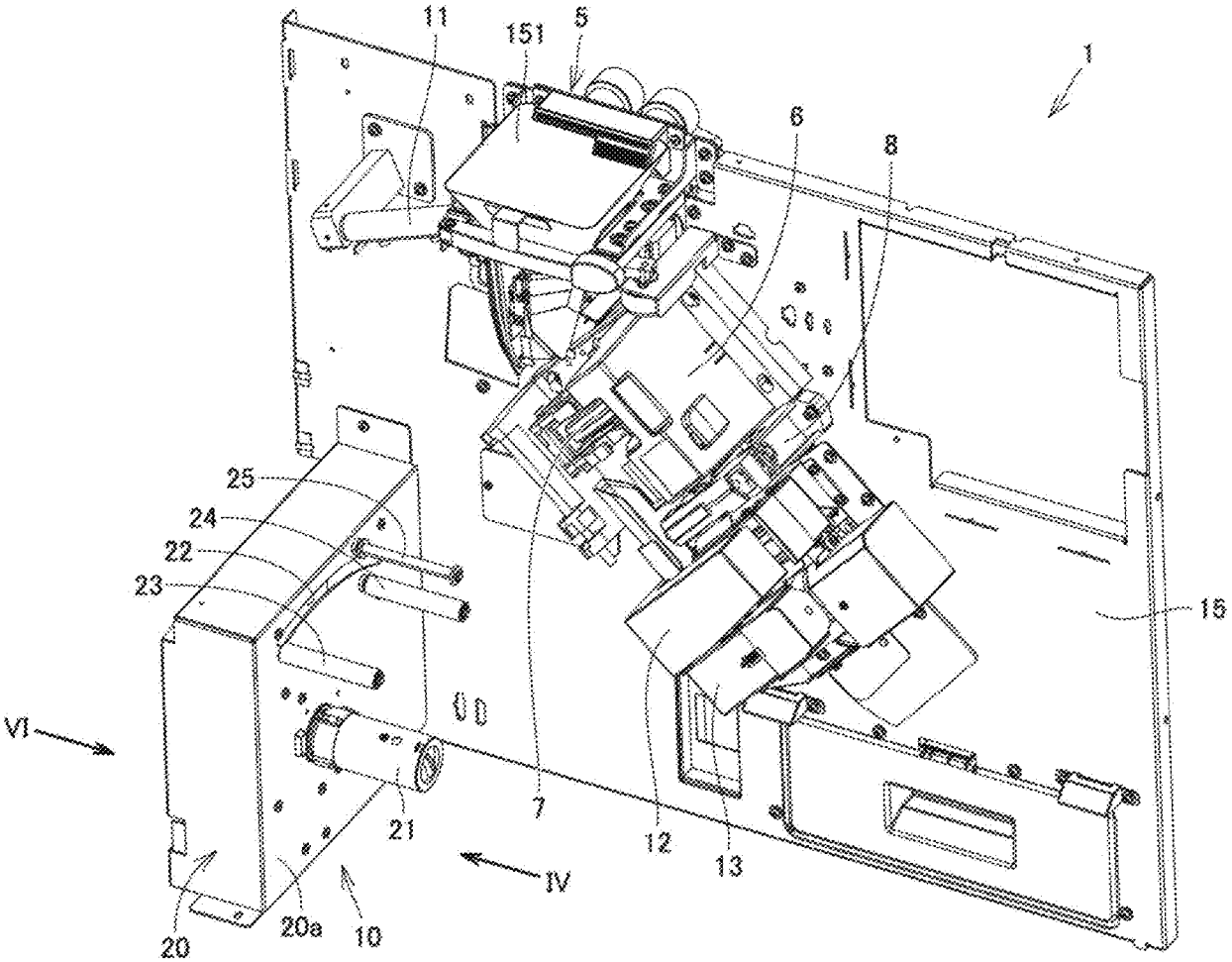
FIG. 3 is a schematic perspective view of the packaging device.

FIG. 3 is a schematic perspective view of packaging device 1. Packaging device 1 further includes a packaging material supply unit 10, a direction changing bar 11, a cutting unit 12, a discharging unit 13, and a frame 15. Devices including supply unit 5, accommodation-part formation unit 6, and packaging material conveyance unit 8, which constitute packaging device 1 are each attached to frame 15. Packaging device 1 is configured to be reciprocable with respect to housing 102 (FIG. 1) in a thickness direction of frame 15. Packaging device 1 is configured to be movable in a front-rear direction with respect to lower housing 104 (FIG. 1) and to be pulled out forward from an accommodation position accommodated in lower housing 104.

Packaging material supply unit 10 includes a substantially box-shaped casing 20 and a mounting target unit 21 to which wound body 3 in FIG. 2 is mounted. Mounting target unit 21 supports wound body 3. Wound body 3 is attached to mounting target unit 21 so as to be relatively non-rotatable with respect to mounting target unit 21. Casing 20 includes a planar outer surface 20*a*. Outer surface 20*a* constitutes a partial surface of box-shaped casing 20. Mounting target unit 21 protrudes from outer surface 20*a* of casing 20 and extends substantially perpendicularly to outer surface 20*a*.

A guide hole 22 is made in outer surface 20*a* of casing 20. Guide hole 22 extends in a gently curved manner. A dancer roller 23 is provided so as to be movable along an extending direction of guide hole 22. Fixed rollers 24, 25 are attached to outer surface 20*a*. Dancer roller 23 and fixed rollers 24, 25 protrude from outer surface 20*a* of casing 20 and extend substantially perpendicularly to outer surface 20*a*. Dancer roller 23 and fixed rollers 24, 25 extend in parallel to each other. Other configurations of packaging material supply unit 10 will be described later.

Packaging material 2 unwound from wound body 3 is wound around fixed roller 24, dancer roller 23, and fixed roller 25 in this order. Packaging material 2 is further wound around direction changing bar 11. Direction changing bar 11 changes conveyance direction DR of packaging material 2 and moves packaging material 2 in a direction oriented to supply unit 5. Packaging material 2 is further wound around packaging unit 9 (FIG. 2) through supply unit 5.

At the drug supply position where supply unit 5 supplies the drug to packaging material 2, packaging material 2 is folded in two along a center line in the short direction of packaging material 2. Supply unit 5 includes a hopper 151. Hopper 151 guides the drug dispensed from the drug accommodation and dispensing device accommodated in upper housing 103 (FIG. 1) to packaging material 2. A tip of hopper 151 is disposed so as to enter the inside of packaging material 2 folded in two. The drug is guided by hopper 151 thereby entering the inside of packaging material 2 folded in two.

Cutting unit 12 is provided on the downstream side of accommodation-part formation unit 6 and packaging material conveyance unit 8 constituting packaging unit 9 in conveyance direction DR. Cutting unit 12 cuts packaging material 2 in which the drug is accommodated. Discharging unit 13 is provided on the downstream side of cutting unit 12 in conveyance direction DR. Discharging unit 13 generates the driving force conveying packaging material 2 cut by cutting unit 12, and discharges packaging material 2 to the outside. Hereinafter, a path through which packaging material 2 unwound from wound body 3 and conveyed to discharging unit 13 passes is referred to as a "conveyance path".

Figure 4:
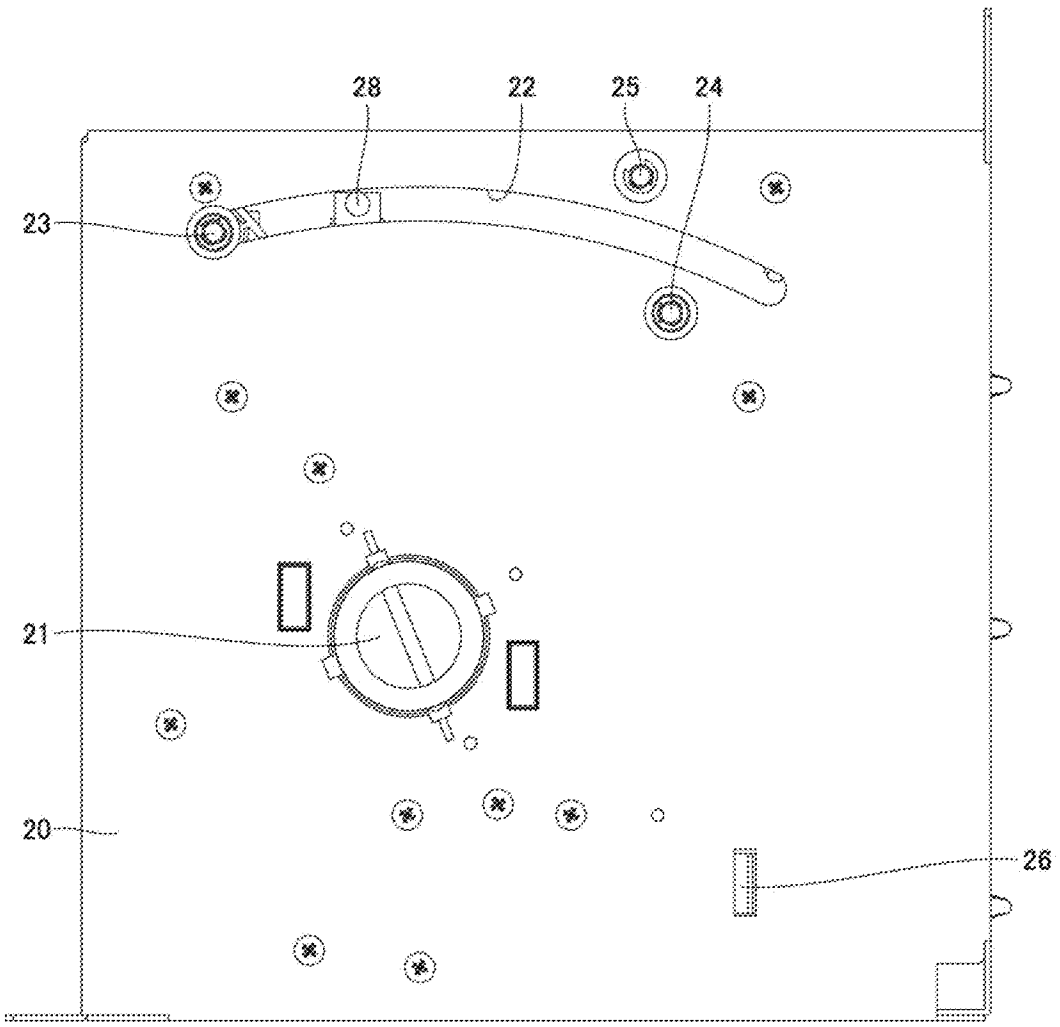
FIG. 4 is a front view of a packaging material supply unit.

FIG. 4 is a front view of packaging material supply unit 10. FIG. 4 illustrates packaging material supply unit 10 when viewed from a direction of an arrow IV in FIG. 3. Dancer roller 23 moves relative to casing 20 along guide hole 22 formed in casing 20. Dancer roller 23 is configured to be displaceable in a direction intersecting the conveyance path of packaging material 2.

Packaging material supply unit 10 includes a fixed position sensor 28. Fixed position sensor 28 detects a position of dancer roller 23. Fixed position sensor 28 is a magnetic sensor. A magnet is attached to a later-described main arm to which dancer roller 23 is attached. A position at which dancer roller 23 overlaps fixed position sensor 28 in the direction perpendicular to a paper surface in FIG. 4 is referred to as a fixed position. The fixed position is on the conveyance path. When dancer roller 23 is at the fixed position, fixed position sensor 28 is turned on by detecting magnetic force. When dancer roller 23 moves away from the fixed position, fixed position sensor 28 switches from on to off. Thus, fixed position sensor 28 detects whether dancer roller 23 is at the fixed position. Fixed position sensor 28 constitutes a position detector of the embodiment that detects that dancer roller 23 is at the fixed position.

Packaging material supply unit 10 includes an unlocking unit 26. The main arm is locked by a locking unit (described later). By manually operating unlocking unit 26, the main arm locked by the locking unit is released.

Figure 5:
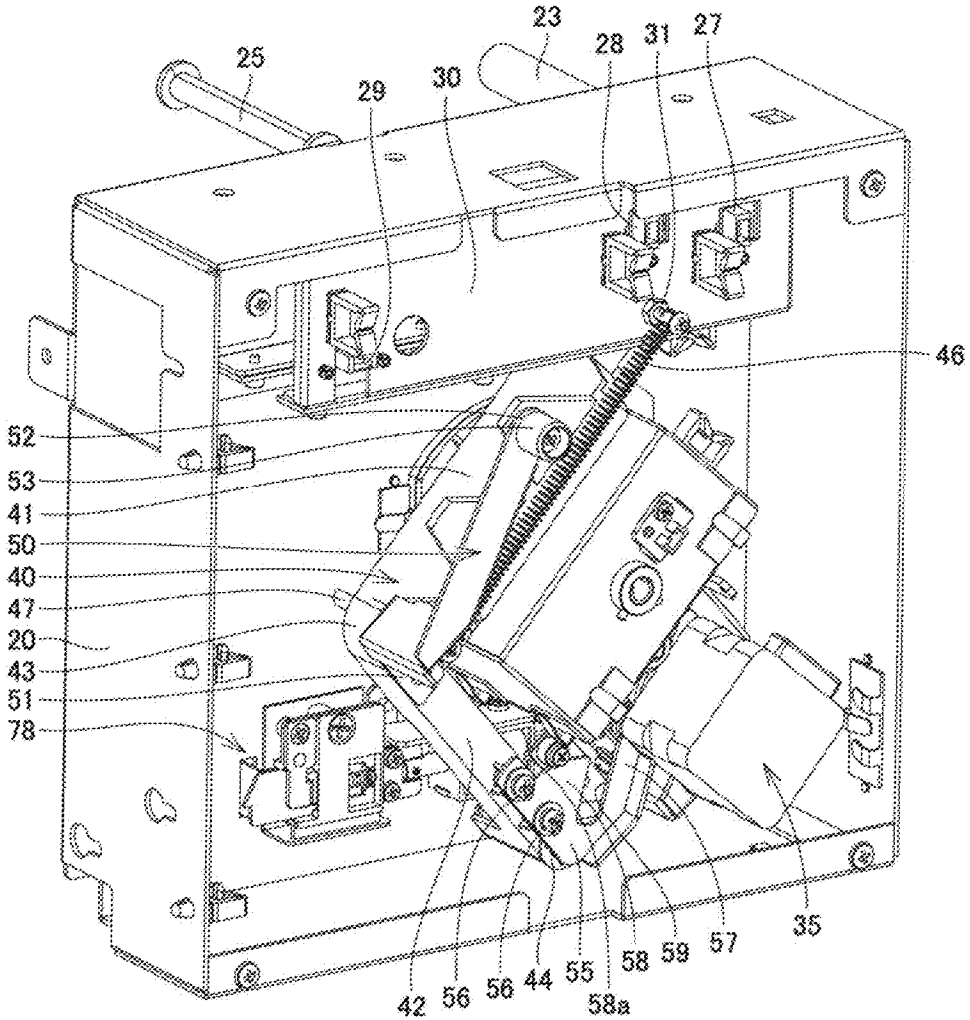
FIG. 5 is a perspective view illustrating a rear surface of the packaging material supply unit.
Figure 6:
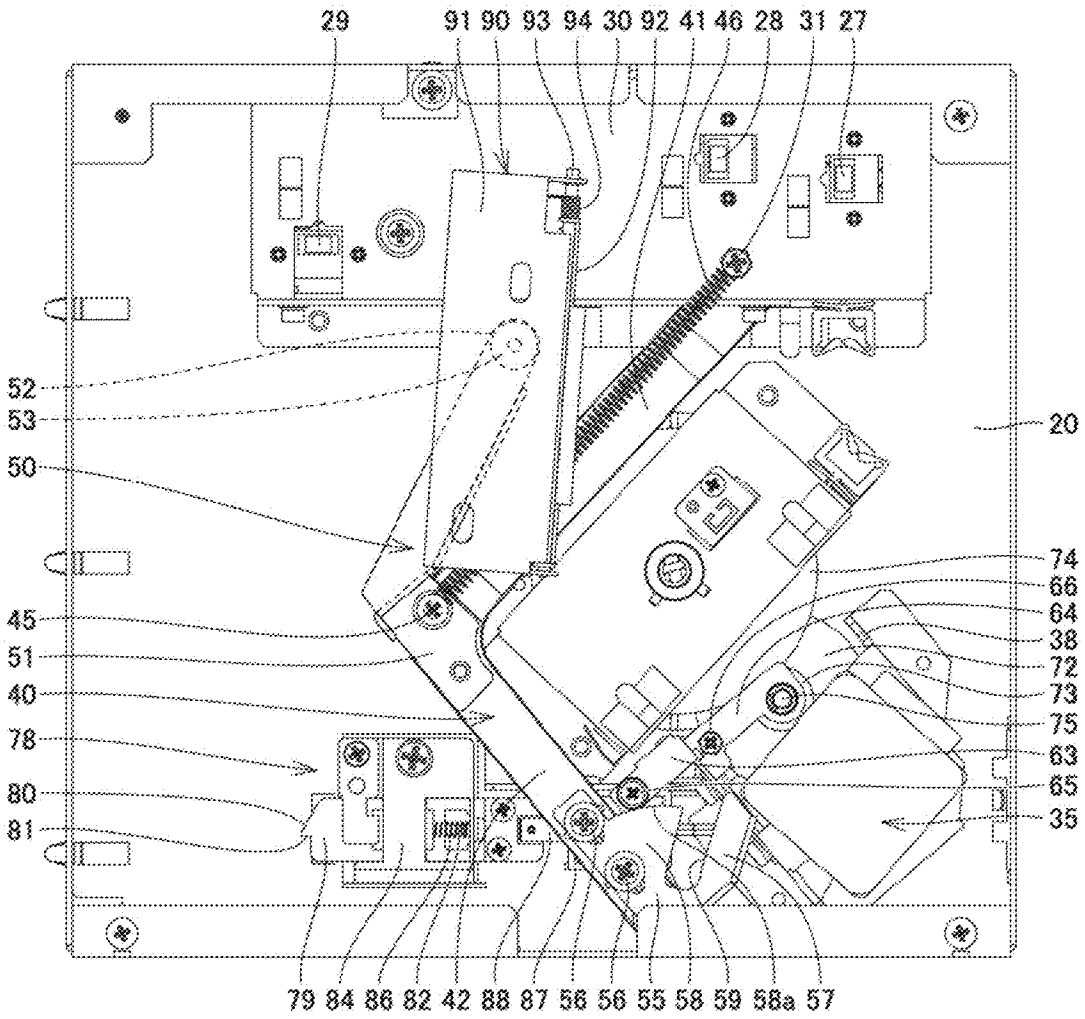
FIG. 6 is a rear view of the packaging material supply unit.

FIG. 5 is a perspective view illustrating a rear surface of packaging material supply unit 10. FIG. 6 is a rear view of packaging material supply unit 10. FIG. 6 illustrates packaging material supply unit 10 when viewed from the direction of the arrow VI in FIG. 3. Packaging material supply unit 10 includes a limit position sensor 27 and a retracted position sensor 29 in addition to fixed position sensor 28. Limit position sensor 27, fixed position sensor 28, and retracted position sensor 29 are supported by a sensor support 30. Sensor support 30 is fixed to a ceiling of casing 20.

The position where dancer roller 23 is disposed in FIG. 4 is referred to as a limit position. The limit position is at one end of guide hole 22. The position of the other end of guide hole 22 is referred to as a retracted position. Limit position sensor 27 and retracted position sensor 29 are magnetic sensors. The limit position and the retraction position are out of the conveyance path. The limit position is farther from the conveyance path than the fixed position.

Limit position sensor 27 and retracted position sensor 29 detect the position of dancer roller 23. When dancer roller 23 is at the limit position, limit position sensor 27 is turned on by detecting the magnetic force. When dancer roller 23 moves away from the limit position, limit position sensor 27 switches from on to off. Thus, limit position sensor 27 detects whether dancer roller 23 is at the limit position. When dancer roller 23 is at the retracted position, retracted position sensor 29 is turned on by detecting the magnetic force. When dancer roller 23 moves away from the retracted position, retracted position sensor 29 switches from on to off. Thus, retracted position sensor 29 detects whether dancer roller 23 is at the retracted position.

Packaging material supply unit 10 includes an unwinding and winding motor 35. Unwinding and winding motor 35 of the embodiment is a stepping motor. Unwinding and winding motor 35 is supported by casing 20. Unwinding and winding motor 35 generates rotational driving force for rotating mounting target unit 21 to unwind packaging material 2 from wound body 3 or to wind packaging material 2 onto wound body 3. The driving force generated by unwinding and winding motor 35 is transmitted to mounting target unit 21 through an intermediate gear 72, an intermediate pinion gear 73, and a roller gear 74. Intermediate gear 72 and intermediate pinion gear 73 are integrally rotatably fixed around an intermediate gear shaft 75.

Packaging material supply unit 10 includes a main arm 40, a sub-arm 50, and a gear positioning plate 55. Main arm 40 includes a first arm 41, a second arm 42, and a bent portion 43. Each of first arm 41 and second arm 42 in FIG. 6 has a substantially linear shape. First arm 41, second arm 42, and bent portion 43 are integrally rotatably fixed to each other. Main arm 40 has a substantially L-shape bent at bent portion 43.

First arm 41 has a distal end and a proximal end. Dancer roller 23 is fixed to the distal end of first arm 41. First arm 41 is connected to bent portion 43 at the proximal end of first arm 41. Second arm 42 has a distal end and a proximal end. Gear positioning plate 55 is fixed to the proximal end of second arm 42. Second arm 42 is connected to bent portion 43 at the distal end of second arm 42. A lock pin 47 is fixed to bent portion 43. Main arm 40 is configured to be rotatable about an arm rotation shaft 44 as a rotation center. Main arm 40 is supported by casing 20 through arm rotation shaft 44.

Sub-arm 50 has a proximal end portion 51 and a distal end portion 52. Proximal end portion 51 is in surface contact with the surface of main arm 40 from bent portion 43 to second arm 42 of main arm 40, and is fixed to main arm 40 using a plurality of fixing members such as bolts. Thus, sub-arm 50 is configured to be rotatable integrally with main arm 40. A cylindrical portion 53 is attached to distal end portion 52 of sub-arm 50.

One of the plurality of fixing members fixing sub-arm 50 to main arm 40 constitutes a spring hook 45. A spring hook 31 is also provided in sensor support 30. Spring hook 31 is configured by a bolt attached to sensor support 30. One end of a return spring 46 is engaged with spring hook 31, and the other end of return spring 46 is engaged with spring hook 45. For example, return spring 46 is a coil spring.

Gear positioning plate 55 is fixed to the proximal end of second arm 42 of main arm 40 using a plurality of fixing members 56 such as bolts. A notch 59 is formed in gear positioning plate 55. Gear positioning plate 55 includes a first portion 57 and a second portion 58. First portion 57 and second portion 58 are separated by notch 59. A part of the edge portion of second portion 58 forms an arcuate edge 58*a*. Arcuate edge 58*a* has an arcuate shape centered on arm rotation shaft 44.

A cylindrical portion 65 is provided while abutting on arcuate edge 58*a*. Cylindrical portion 65 is attached to a distal end portion of a second portion 63 of the gear arm. A distal end portion of a third portion 64 of the gear arm is engaged with intermediate gear shaft 75 through a bearing. A spring hook 66 is formed in third portion 64. One end of a return spring (not illustrated) is engaged with a spring hook 38, and the other end is engaged with spring hook 66.

An outer peripheral surface of cylindrical portion 65 is slidable with respect to arcuate edge 58*a*. Cylindrical portion 65 is also movable into notch 59. Intermediate gear 72 and intermediate pinion gear 73 are positioned by abutting the outer peripheral surface of cylindrical portion 65 on arcuate edge 58*a*, and intermediate gear 72 and intermediate pinion gear 73 change their positions by moving cylindrical portion 65 into notch 59.

Packaging material supply unit 10 further includes a lock 78. Lock 78 includes a lock member 79. Lock member 79 has an inclined portion 80 and an engaging portion 81 at an end on one side (left side in FIG. 6). Lock member 79 has a coupling piece at an end on the other side (right side in FIG. 6). Lock member 79 also has a protrusion 82.

Lock member 79 is held by a holding member 84. Holding member 84 is fixed to casing 20. Holding member 84 holds lock member 79 slidably in an extending direction (left-right direction in FIG. 6). Holding member 84 has a protrusion. Protrusion 82 of lock member 79 and the protrusion of holding member 84 are disposed such that distal end portions thereof are opposite to each other. A spring 86 is provided across protrusion 82 of lock member 79 and the protrusion of holding member 84. Protrusion 82 supports one end of spring 86 (left end of spring 86 in FIG. 6). The protrusion of holding member 84 supports the other end of spring 86 (right end of spring 86 in FIG. 6).

Lock 78 also includes a linear solenoid actuator 87. Linear solenoid actuator 87 is fixed to casing 20 by a holding member (not illustrated). Linear solenoid actuator 87 includes a main body and a stem 88 protruding from the main body. Stem 88 is coupled to a coupling piece of lock member 79.

Lock 78 is configured to lock main arm 40 by engaging with lock pin 47 attached to main arm 40.

Packaging device 1 includes a spring hinge 90. Spring hinge 90 includes a first hinge plate 91, a second hinge plate 92, a hinge shaft 93, and a torsion spring 94. First hinge plate 91 and second hinge plate 92 are coupled to each other through hinge shaft 93.

First hinge plate 91 is fixed to lower housing 104 and is not movable. Second hinge plate 92 is relatively movable with respect to first hinge plate 91 about hinge shaft 93 as a rotation center. Second hinge plate 92 is disposed to be inclined with respect to a vertical direction such that an upper end of second hinge plate 92 is relatively on the front side (right direction in the figure) and such that a lower end of second hinge plate 92 is relatively on the rear side (left direction in the figure).

Torsion spring 94 has a coil wound around hinge shaft 93 and a pair of arms protruding from the coil. One of the pair of arms abuts on first hinge plate 91. The other of the pair of arms abuts on second hinge plate 92.

Torsion spring 94 applies elastic repulsive force between first hinge plate 91 and second hinge plate 92, and biases second hinge plate 92 in a direction in which second hinge plate 92 is separated from first hinge plate 91 with hinge shaft 93 as a rotation center. First hinge plate 91 and second hinge plate 92 extend substantially orthogonally in a state where biasing force of torsion spring 94 and external force other than gravity do not act on spring hinge 90. When viewed in the axial direction of hinge shaft 93, first hinge plate 91 and second hinge plate 92 are disposed in an L-shape.

Packaging material supply unit 10 is movable relative to spring hinge 90 in the front-back direction (left-right direction in FIG. 6) of housing 102. In the disposition of FIG. 6, cylindrical portion 53 of sub-arm 50 is separated from second hinge plate 92, and cylindrical portion 53 and second hinge plate 92 are in a non-contact state. Cylindrical portion 53 is configured to slide with respect to second hinge plate 92 of spring hinge 90, thereby rotating sub-arm 50 and main arm 40 about arm rotation shaft 44.

Figure 7:
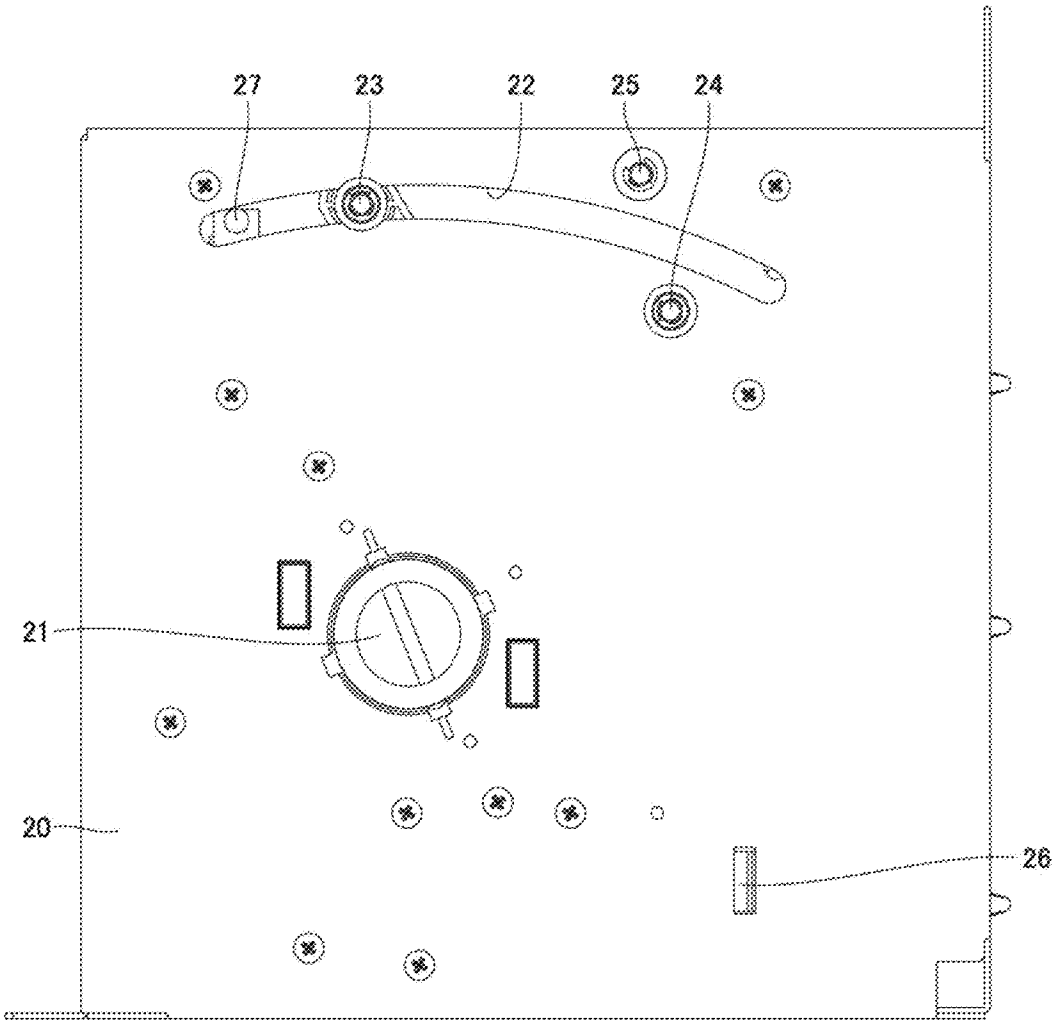
FIG. 7 is a front view illustrating the packaging material supply unit when a dancer roller is at a fixed position.

FIG. 7 is a front view illustrating packaging material supply unit 10 when dancer roller 23 is at the fixed position. Dancer roller 23 in FIG. 7 moves to the right in the drawing along guide hole 22 as compared with FIG. 4. Dancer roller 23 in FIG. 7 is located at the fixed position away from the limit position. Limit position sensor 27 is illustrated in FIG. 7 because dancer roller 23 is away from the limit position in FIG. 4. On the other hand, in FIG. 7, because dancer roller 23 is at the fixed position, dancer roller 23 overlaps fixed position sensor 28, and fixed position sensor 28 is not illustrated.

As described above, packaging material 2 unwound from wound body 3 (not illustrated in FIG. 7) is wound around fixed roller 24, dancer roller 23, and fixed roller 25 in this order. When dancer roller 23 is at the fixed position, a predetermined tension is applied to packaging material 2. The occurrence of slack of packaging material 2 is suppressed by applying the tension to packaging material 2. Accordingly, displacement, wrinkling, and the like of packaging material 2 are suppressed when packaging material conveyance unit 8 (FIGS. 2 and 3) conveys packaging material 2.

Figure 8:
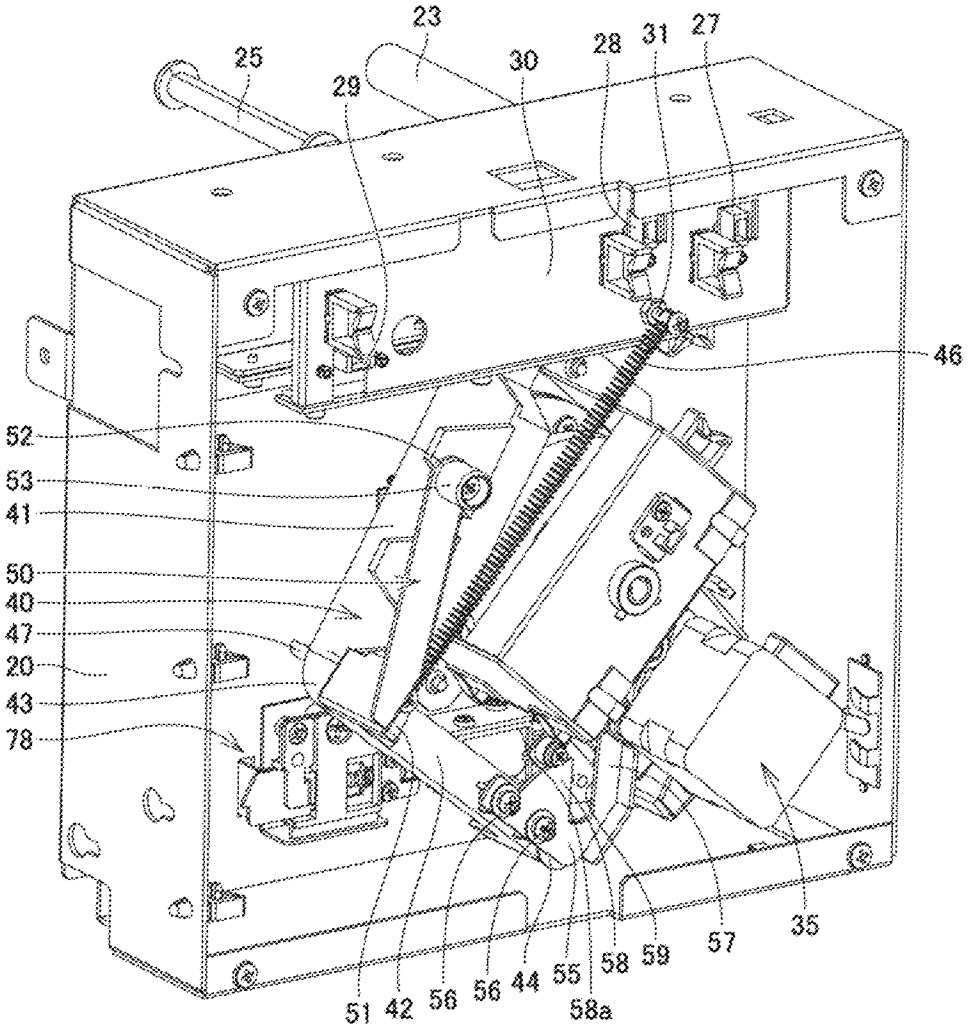
FIG. 8 is a perspective view illustrating the rear surface of the packaging material supply unit when the dancer roller is at the fixed position.

FIG. 8 is a perspective view illustrating the rear surface of packaging material supply unit 10 when dancer roller 23 is at the fixed position. Main arm 40 and sub-arm 50 in FIG. 8 rotate counterclockwise around arm rotation shaft 44 as compared with FIG. 5. Gear positioning plate 55 rotates together with main arm 40 and the cylindrical portion 65 relatively moves along arcuate edge 58*a* of gear positioning plate 55, so that cylindrical portion 65 in FIG. 8 is located closer to notch 59 as compared with FIG. 5. Lock pin 47 in FIG. 8 moves in a direction approaching lock 78 as compared with FIG. 5. Return spring 46 in FIG. 8 has a length larger than that in FIG. 5.

Figure 9:
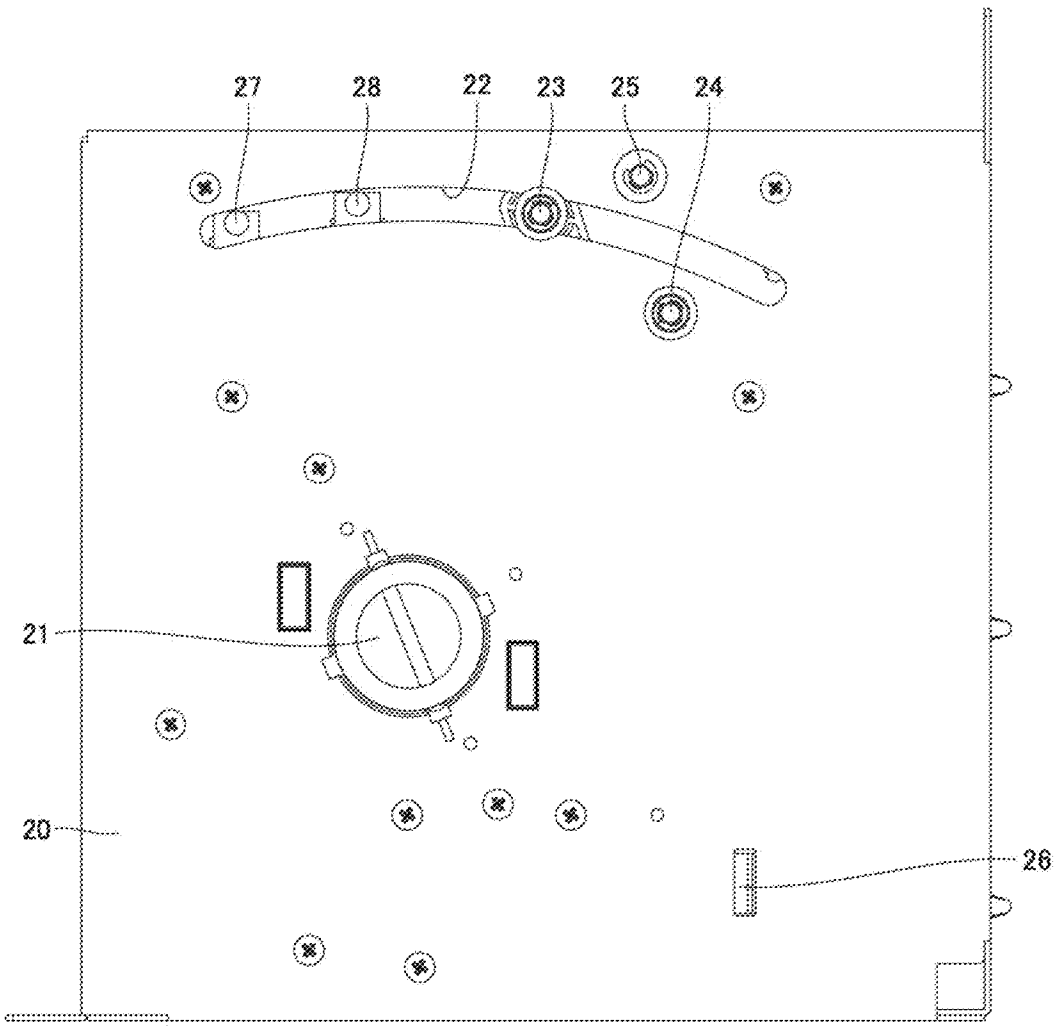
FIG. 9 is a front view illustrating the packaging material supply unit when the dancer roller is at a movement position during conveyance.

FIG. 9 is a front view illustrating packaging material supply unit 10 when dancer roller 23 is at the movement position during conveyance. Dancer roller 23 in FIG. 9 moves to the right in the drawing along guide hole 22 as compared with FIG. 7. Dancer roller 23 in FIG. 9 is away from the fixed position, so that both limit position sensor 27 and fixed position sensor 28 are illustrated in FIG. 9. The position where dancer roller 23 is disposed in FIG. 7 is referred to as the movement position during conveyance. The movement position during conveyance is located on the conveyance path.

FIG. 9 illustrates dancer roller 23 after packaging material 2 is conveyed by packaging material conveyance unit 8 by the length of one package in which the drug is accommodated, which moved from the fixed position along with the conveyance of packaging material 2. Unwinding and winding motor 35 is stopped while packaging material conveyance unit 8 conveys packaging material 2. For this reason, packaging material 2 is not unwound from wound body 3.

On the other hand, packaging material conveyance unit 8 conveys packaging material 2 by one package, whereby the length of packaging material 2 in conveyance direction DR from wound body 3 to packaging material conveyance unit 8 is shortened by one package. Dancer roller 23 is moved to shorten the distance between dancer roller 23 and fixed roller 24 and the distance between dancer roller 23 and fixed roller 25, whereby the change in the length of packaging material 2 is adjusted.

That is, the length of packaging material 2 in FIG. 9 is shorter when the length of packaging material 2 wound between dancer roller 23 at fixed position in FIG. 7 and fixed rollers 24, 25 is compared to the length of packaging material 2 wound between dancer roller 23 at the position in FIG. 9 and fixed rollers 24, 25. The change in the length of packaging material 2 wound between dancer roller 23 and fixed rollers 24, 25 corresponds to the length of one package, so that packaging material 2 can be conveyed while the state in which the predetermined tension is applied to packaging material 2 is maintained constant.

The length of one package in conveyance direction DR is not always constant, and may be changed according to the amount of the drug accommodated in the package. The amount of packaging material 2 conveyed by packaging material conveyance unit 8 can also be changed according to the size of the package, and the movement position during conveyance also varies. When the length of one package is large in conveyance direction DR, the movement position during conveyance is set at a position relatively away from the fixed position. When the length of one package is small in conveyance direction DR, the movement position during conveyance is set at a position relatively close to the fixed position.

Packaging material 2 is intermittently conveyed. After the conveyance of packaging material 2 is executed, unwinding and winding motor 35 is driven while conveyance of packaging material 2 is stopped. When the driving force of unwinding and winding motor 35 is transmitted to mounting target unit 21 to rotate wound body 3, packaging material 2 is unwound from wound body 3. Because the conveyance of packaging material 2 by packaging material conveyance unit 8 is stopped during the unwinding, packaging material 2 unwound from wound body 3 is used to restore the length of packaging material 2 wound between dancer roller 23 and fixed rollers 24, 25 to the original length. That is, when packaging material 2 is unwound from wound body 3, dancer roller 23 moves from the movement position during conveyance in FIG. 9 toward the fixed position in FIG. 7. When dancer roller 23 is moved to the fixed position and detected by fixed position sensor 28, unwinding and winding motor 35 is stopped.

As described above, by alternately repeating the conveyance of packaging material 2 by packaging material conveyance unit 8 and the unwinding of packaging material 2 from wound body 3, packaging material 2 can be appropriately conveyed while maintaining the state in which the predetermined tension is applied to packaging material 2.

Figure 10:
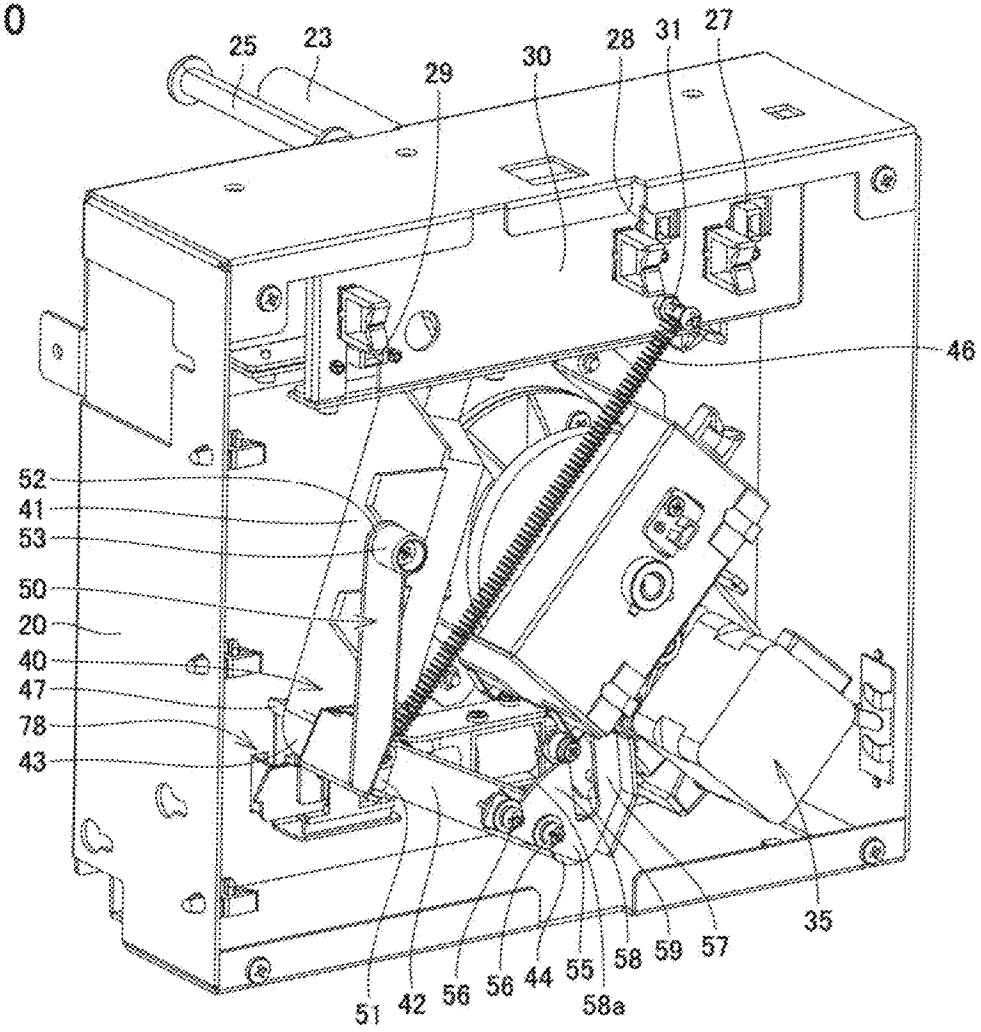
FIG. 10 is a perspective view illustrating the rear surface of the packaging material supply unit when the dancer roller is at the movement position during conveyance.

FIG. 10 is a perspective view illustrating the rear surface of packaging material supply unit 10 when dancer roller 23 is at the movement position during conveyance. Main arm 40 and sub-arm 50 in FIG. 10 rotate counterclockwise around arm rotation shaft 44 as compared with FIG. 8. Gear positioning plate 55 rotates together with main arm 40 and cylindrical portion 65 relatively moves along arcuate edge 58*a* of gear positioning plate 55, so that cylindrical portion 65 in FIG. 10 is located closer to notch 59 as compared with FIG. 8. Lock pin 47 in FIG. 10 moves in the direction approaching lock 78 as compared with FIG. 8. Return spring 46 in FIG. 10 has a length larger than that in FIG. 8.

As described above, when packaging material 2 is conveyed by packaging material conveyance unit 8, the state in which the tension is applied to packaging material 2 is maintained, and dancer roller 23 reciprocates between the fixed position and the movement position during conveyance. When all packaging materials 2 are unwound from wound body 3, the upstream end of packaging material 2 in conveyance direction DR is not supported by wound body 3, and thus the tension is not applied to packaging material 2. Because dancer roller 23 is not supported by packaging material 2 to which the tension is applied, main arm 40 rotates by the elastic force of return spring 46, whereby dancer roller 23 moves to the limit position.

Figure 11:
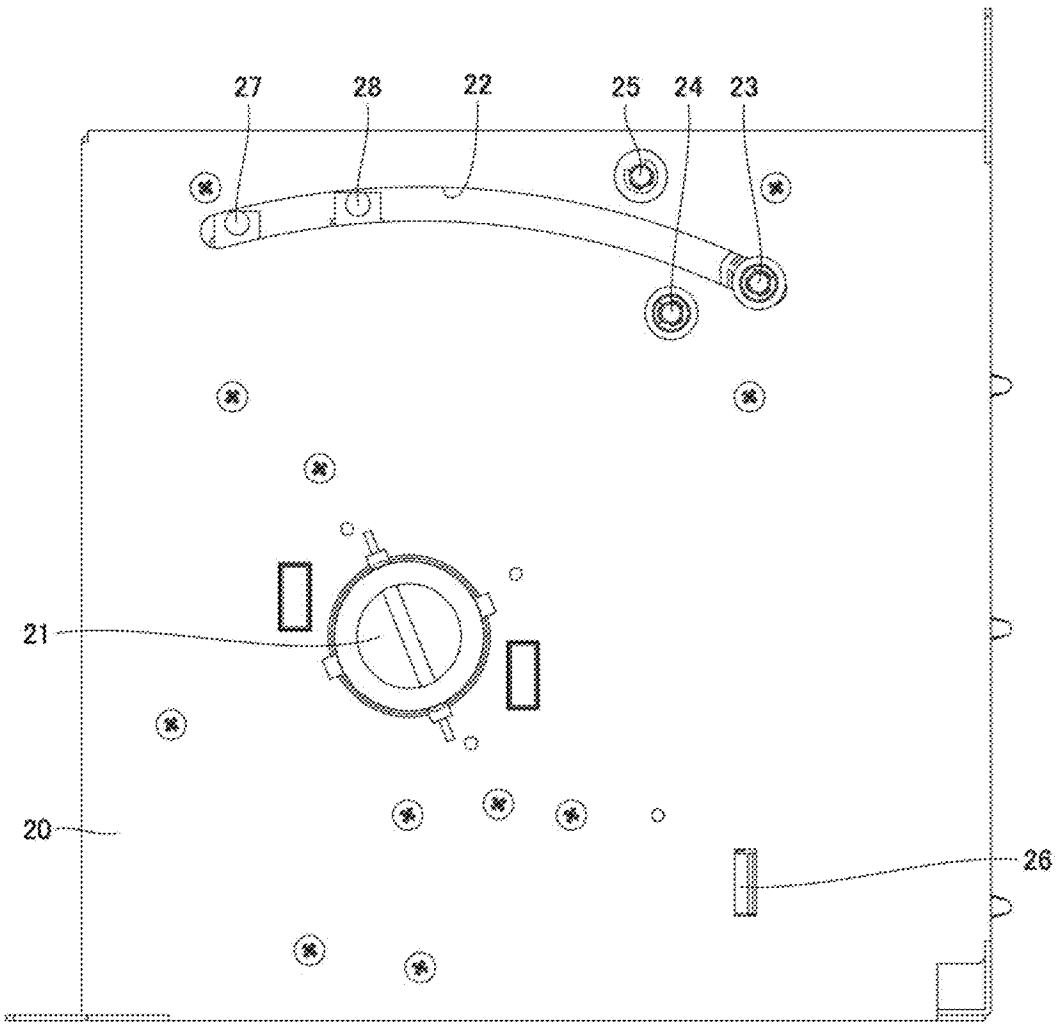
FIG. 11 is a front view illustrating the packaging material supply unit when the dancer roller is at a retracted position.

FIG. 11 is a front view illustrating packaging material supply unit 10 when dancer roller 23 is at the retracted position. Dancer roller 23 in FIG. 11 moves to the right of FIG. 11 along guide hole 22 as compared with FIG. 9. Dancer roller 23 in FIG. 11 is located at the retracted position in the other end of guide hole 22.

In FIGS. 7 and 9, dancer roller 23 is located on the left side with respect to fixed rollers 24, 25. For this reason, packaging material 2 wound around fixed roller 24, dancer roller 23, and fixed roller 25 in this order is pressed by dancer roller 23, whereby the tension is applied to packaging material 2. On the other hand, in FIG. 11, dancer roller 23 is located on the right side with respect to fixed rollers 24, 25. Packaging material 2 unwound from wound body 3 can pass through a gap between dancer roller 23 and fixed roller 24 in the left-right direction in FIG. 11, and pass through a gap between dancer roller 23 and fixed roller 25. In this state, the tension is not applied to packaging material 2.

In the state where packaging material 2 is passed through the gap between dancer roller 23 and fixed rollers 24, 25 in the left-right direction of FIG. 11, dancer roller 23 is moved to the fixed position, whereby the tension is applied to packaging material 2.

Dancer roller 23 and fixed rollers 24, 25 constitute a tension applying unit that applies the tension to packaging material 2 unwound from wound body 3. Dancer roller 23 presses packaging material 2, whereby the tension applying unit applies the tension to packaging material 2. Dancer roller 23 constitutes a displacement member that can be displaced in a direction intersecting the conveyance path of packaging material 2. By moving dancer roller 23, the tension applying unit can switch between an applied state in which the tension is applied to packaging material 2 and a non-applied state in which the tension is not applied to packaging material 2.

Figure 12:
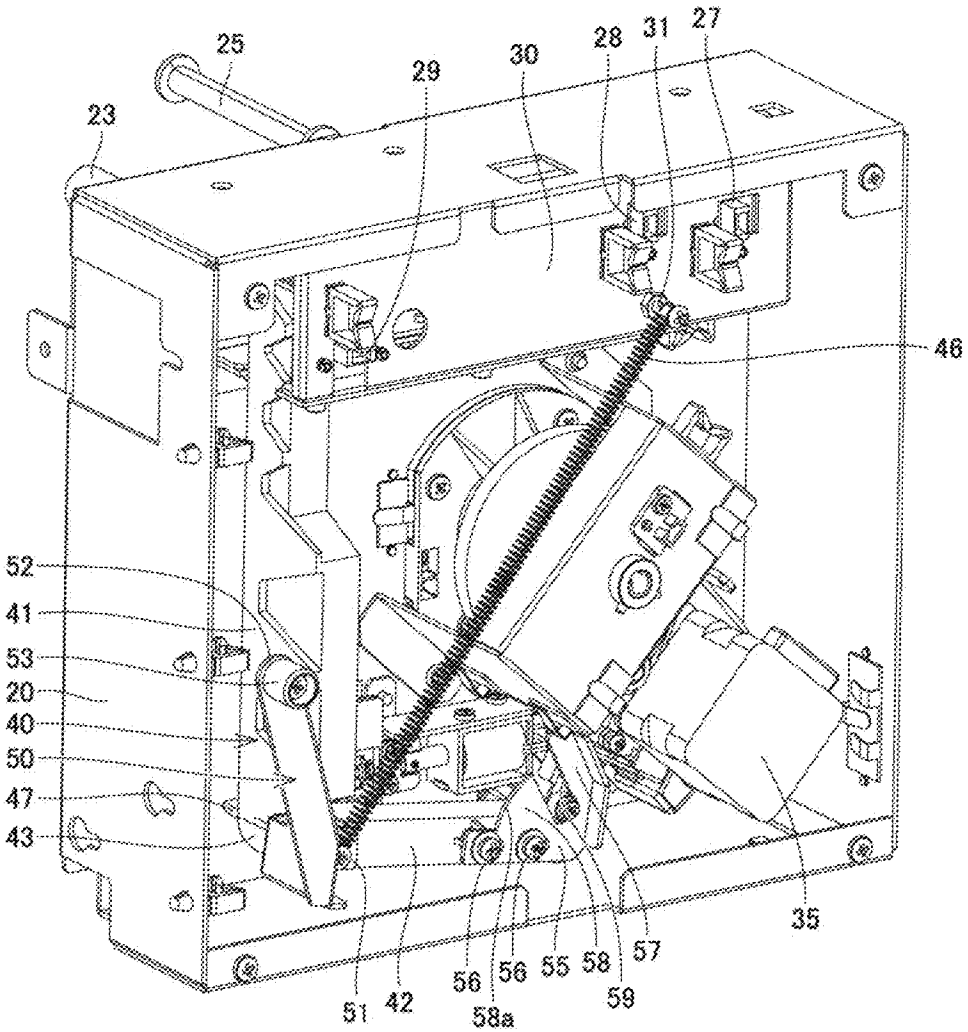
FIG. 12 is a perspective view illustrating the rear surface of the packaging material supply unit when the dancer roller is at the retracted position.

FIG. 12 is a perspective view illustrating the rear surface of packaging material supply unit 10 when dancer roller 23 is at the retracted position. Main arm 40 and sub-arm 50 in FIG. 12 rotate counterclockwise around arm rotation shaft 44 as compared with FIG. 10. Cylindrical portion 65 in FIG. 12 is located in notch 59 away from arcuate edge 58*a* of gear positioning plate 55. Lock pin 47 in FIG. 12 is engaged with lock 78 (not illustrated in FIG. 12), so that main arm 40 is locked. Return spring 46 in FIG. 12 has a length larger than that in FIG. 10, and has the maximum length.

Figure 13:
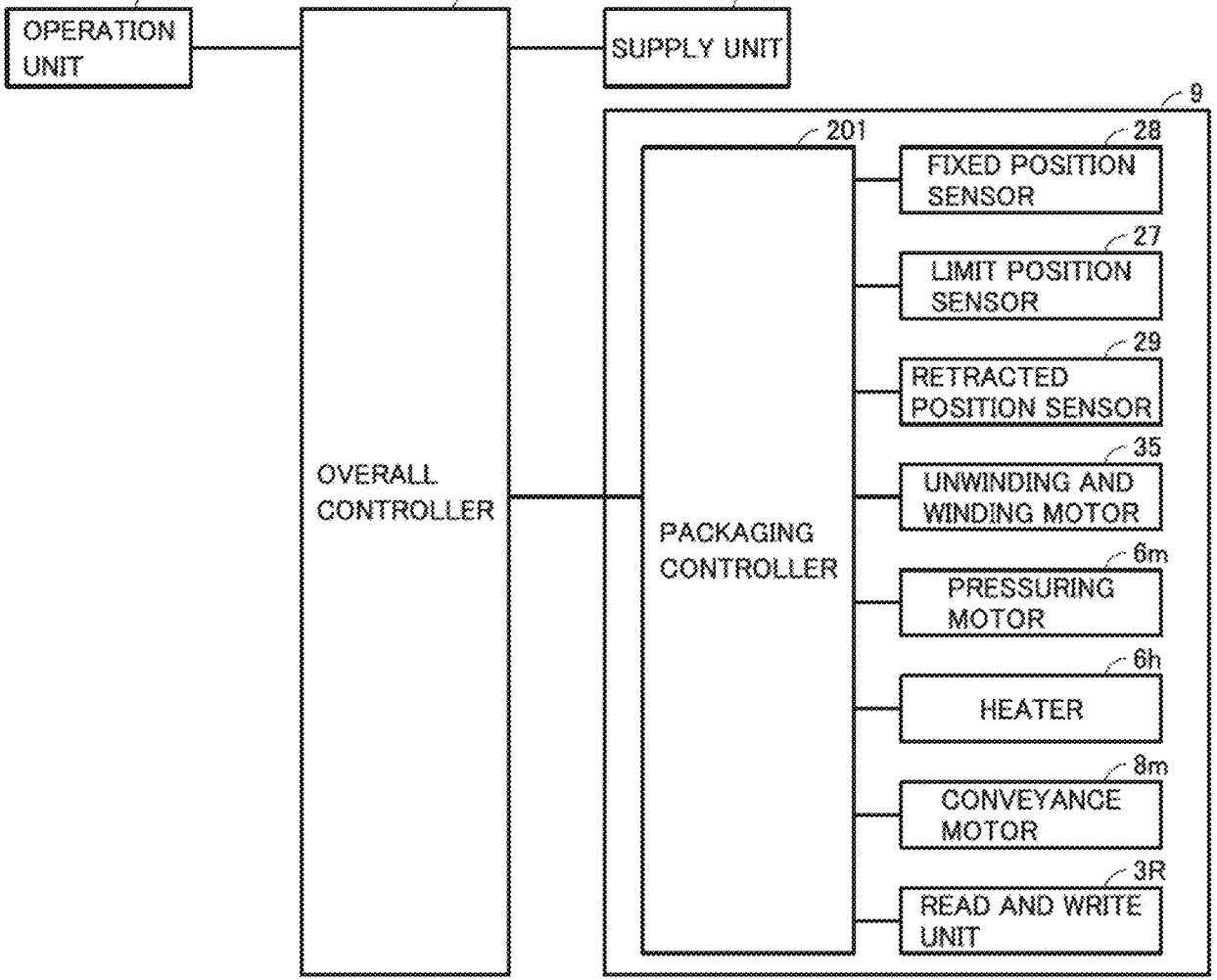
FIG. 13 is a block diagram illustrating an electric configuration of the packaging device of the embodiment.

The control for executing the dispensing operation using packaging device 1 will be described below. FIG. 13 is a block diagram illustrating an electric configuration of packaging device 1 of the embodiment. As illustrated in FIG. 13, packaging device 1 includes an operation unit 107 and an overall controller 200.

Operation unit 107 is operated by an operator who operates packaging device 1. When the operator operates operation unit 107, information necessary for the packaging operation of packaging device 1 is input to overall controller 200. The information necessary for the packaging operation of packaging device 1 includes prescription data based on the prescription and various pieces of setting information. The setting information includes a length of one package in which the drug is accommodated. The information necessary for the packaging operation of packaging device 1 may be input to overall controller 200 from an external computer.

Overall controller 200 controls the overall operation of packaging device 1 based on the information necessary for the packaging operation of packaging device 1. Overall controller 200 controls supply unit 5 and packaging unit 9.

Overall controller 200 transmits a control signal to supply unit 5 to command the type and quantity of the drug to be supplied by supply unit 5. Overall controller 200 transmits a control signal to packaging unit 9 so that the length of the package in conveyance direction DR has a predetermined value. For example, the length of the package may be a value input through operation unit 107, or may be a value set by overall controller 200 based on the type and quantity of the drug.

Packaging unit 9 includes a packaging controller 201. Packaging controller 201 receives detection signals of fixed position sensor 28, limit position sensor 27, and retracted position sensor 29, and determines the current position of dancer roller 23. Packaging controller 201 controls unwinding and winding motor 35, a pressurizing motor 6*m*, a heater 6*h*, a conveyance motor 8*m*, and a read and write unit 3R based on control signals from overall controller 200. Packaging material 2 is packaged by appropriately driving and stopping unwinding and winding motor 35, pressurizing motor 6*m*, heater 6*h*, conveyance motor 8*m*, and read and write unit 3R.

Pressurizing motor 6*m* and heater 6*h* are included in the accommodation-part formation unit 6 (FIG. 2). Heater 6*h* is incorporated in one of a pair of pressurizing members disposed to face each other with packaging material 2 interposed therebetween. Pressurizing motor 6*m* drives the pair of pressurizing members to pressurize packaging material 2 from both sides with the pressurizing members or to separate the pressurizing members from packaging material 2. When packaging material 2 is pressurized from both sides, heater 6*h* is driven to heat packaging material 2, so that a part of packaging material 2 is thermally fused to form the package in which the drug is accommodated.

Conveyance motor 8*m* is included in packaging material conveyance unit 8. Conveyance motor 8*m* rotationally drives a pair of conveyance rollers disposed to face each other with packaging material 2 interposed therebetween. Conveyance motor 8*m* rotationally drives the pair of conveyance rollers, whereby packaging material 2 is conveyed. Packaging material conveyance unit 8 intermittently conveys packaging material 2. Predetermined operations such as the thermal fusion of packaging material 2 by accommodation-part formation unit 6, the printing of predetermined information on packaging material 2 by printing unit 4 (FIG. 2), the formation of the perforation in packaging material 2 by perforation forming unit 7 (FIG. 2), and the cutting of packaging material 2 by cutting unit 12 (FIG. 3) are performed while the conveyance of packaging material 2 is stopped.

Read and write unit 3R performs data communication with recording medium 3*b* (FIG. 2) under the control of packaging controller 201. Specifically, read and write unit 3R accesses recording medium 3*b* to read information recorded in recording medium 3*b* and to write information in recording medium 3*b*. Read and write unit 3R newly adds information to recording medium 3*b*. Further, read and write unit 3R overwrites and updates the information already recorded in recording medium 3*b* with the latest information.

In the case where operation unit 107 includes a display and the remaining amount information of packaging material 2 is recorded on recording medium 3*b*, a command signal may be output from overall controller 200 to operation unit 107 so as to display the remaining amount information read from recording medium 3*b* on the display. The user who uses packaging device 1 can know the remaining amount information of packaging material 2 by viewing the display. For example, the user who knows that the remaining amount of packaging material 2 is small can previously arrange packaging material 2 for replacement.

Figure 14:
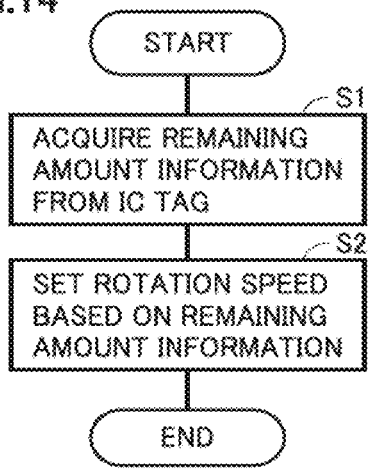
FIG. 14 is a flowchart illustrating setting operation of setting a rotation speed of an unwinding and winding motor.

FIG. 14 is a flowchart illustrating setting operation of setting a rotation speed of unwinding and winding motor 35. In packaging device 1 of the embodiment, the unwinding and winding unit is a configuration unwinding packaging material 2 from wound body 3 or winding packaging material 2 onto wound body 3. The unwinding and winding unit includes unwinding and winding motor 35, mounting target unit 21, a power transmission unit that transmits the driving force generated by unwinding and winding motor 35 to mounting target unit 21, dancer roller 23, each sensor that detects the position of dancer roller 23, and fixed rollers 24, 25. The conveyance unit is a configuration that conveys packaging material 2 along conveyance direction DR. The conveyance unit is configured by packaging material conveyance unit 8.

The setting operation in FIG. 14 is executed during startup at which packaging device 1 is powered on, or when wound body 3 is mounted on mounting target unit 21 in replacing wound body 3. When the setting operation is started, in step S1, the remaining amount information indicating the remaining amount of packaging material 2 in wound body 3 is acquired from an IC tag. Read and write unit 3R (FIG. 13) accesses the IC tag provided in core tube 3*a* of wound body 3, namely, recording medium 3*b* (FIG. 2), and acquires the remaining amount information recorded in recording medium 3*b*. The remaining amount information is input from read and write unit 3R to packaging controller 201.

Subsequently, in step S2, the rotation speed is set based on the remaining amount information. Packaging controller 201 sets the rotation speed of unwinding and winding motor 35 based on the remaining amount information read by read and write unit 3R from recording medium 3*b*.

When the remaining amount of packaging material 2 in wound body 3 is large and a winding diameter of packaging material 2 is large, inertia of wound body 3 is large. For this reason, when the rotation speed of wound body 3 is too high, step-out may occur due to characteristics of the stepping motor. In addition, because the inertia of wound body 3 is large, packaging material 2 is loosened, and the loosening becomes an error, so that accuracy of the winding diameter determination of packaging material 2 is deteriorated. For this reason, when the remaining amount of packaging material 2 is large, the rotation speed is reduced.

When the remaining amount of packaging material 2 in wound body 3 is small and the winding diameter of packaging material 2 is small, the inertia of wound body 3 is small, so that the possibility of step-out is reduced. When the winding diameter is small, as compared with the case where the winding diameter is large, it is necessary to rotate wound body 3 more in order to unwind packaging material 2 having the same length. For this reason, when the remaining amount of packaging material 2 is small, the rotation speed is increased.

As described above, packaging controller 201 sets the rotation speed of unwinding and winding motor 35 according to the remaining amount of packaging material 2 in wound body 3. Then, the setting operation is ended ("end" in FIG. 14).

Figure 15:
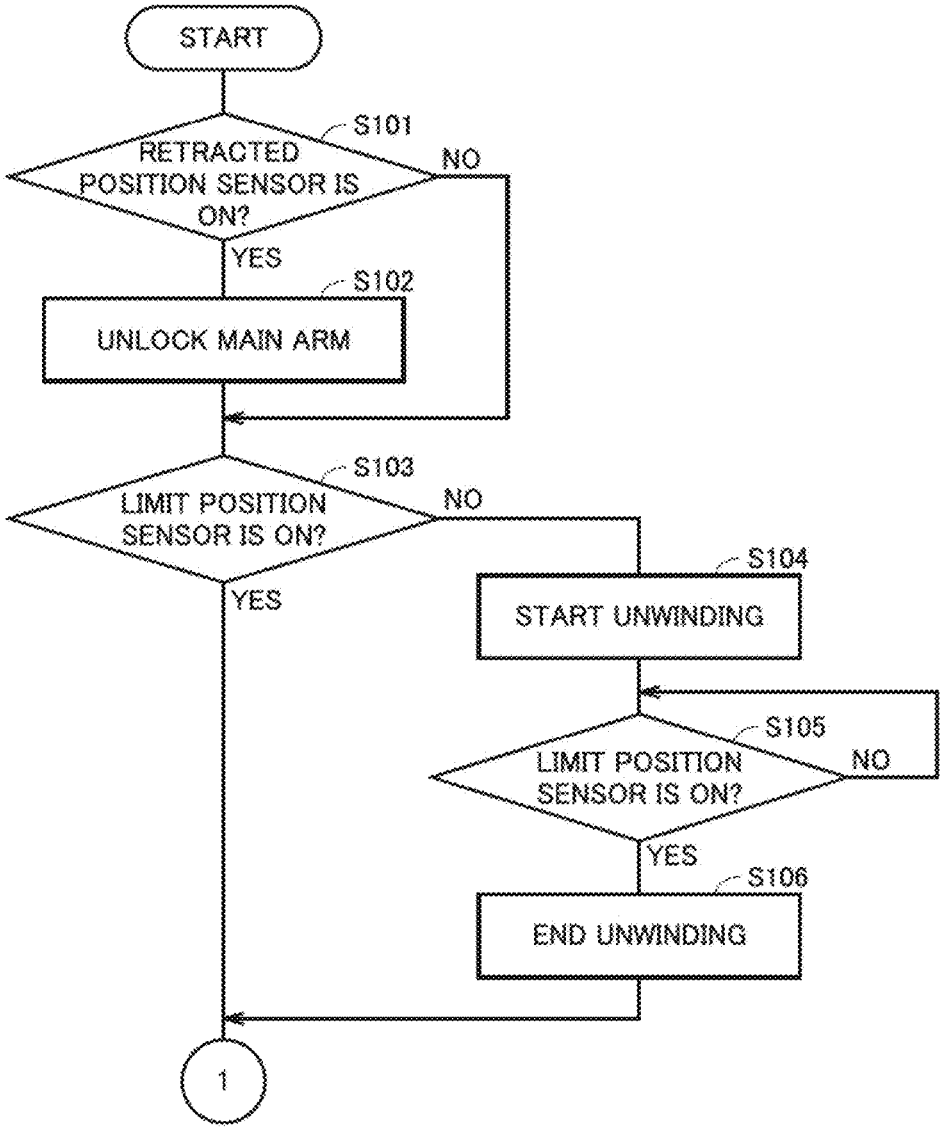
FIG. 15 is a flowchart illustrating a fixed position return operation of the dancer roller during initial operation.
Figure 16:
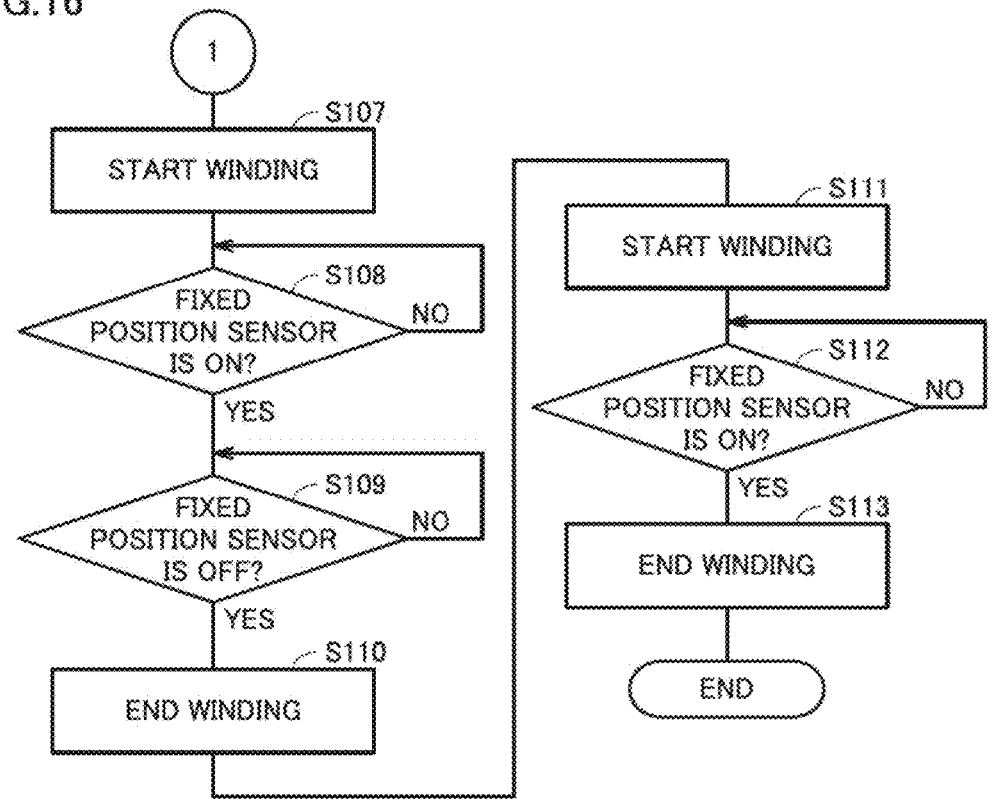
FIG. 16 is a flowchart illustrating the fixed position return operation of the dancer roller during the initial operation.

FIGS. 15 and 16 are flowcharts illustrating the fixed position return operation of dancer roller 23 during the initial operation. When a predetermined key is operated after packaging device 1 is powered on, the initial operation is started. The fixed position return operation of dancer roller 23 is executed as one of the initial operations.

First, whether retracted position sensor 29 is on is determined in step S101. Packaging controller 201 determines whether retracted position sensor 29 is on based on the presence or absence of the input of the detection signal indicating that retracted position sensor 29 is on. When the detection signal is input from retracted position sensor 29, it is determined that dancer roller 23 is in the retracted position (YES in step S101). In this case, the process proceeds to step S102, and main arm 40 is unlocked.

As described with reference to FIG. 12, when dancer roller 23 is at the retracted position, lock pin 47 is engaged with lock 78, and main arm 40 is locked. Main arm 40 is unlocked in order to be able to move dancer roller 23. Linear solenoid actuator 87 pulls lock member 79, thereby releasing main arm 40 locked by lock 78. The user who uses packaging device 1 may manually operate unlocking unit 26 to release main arm 40 locked by lock 78.

Return spring 46 biases main arm 40 in the direction in which dancer roller 23 moves from the retracted position toward the limit position. When main arm 40 is unlocked, main arm 40 rotates by the elastic force of return spring 46, and thus dancer roller 23 moves in the direction from the retracted position toward the limit position. The position to which dancer roller 23 moves after main arm 40 is unlocked is defined according to the unwinding amount of packaging material 2 from wound body 3 at that time.

In the determination of step S101, when the detection signal is not input from retracted position sensor 29 and thereby it is determined that retracted position sensor 29 is not on (NO in step S101), dancer roller 23 is not in the retracted position, and thus main arm 40 is not locked. Step S102 is skipped because the necessity of the unlocking of main arm 40 is eliminated.

Subsequently, in step S103, it is determined whether limit position sensor 27 is on. Packaging controller 201 determines whether limit position sensor 27 is on based on the presence or absence of the input of the detection signal indicating that limit position sensor 27 is on. When the detection signal is not input from limit position sensor 27 and thereby it is determined that limit position sensor 27 is not on (NO in step S103), dancer roller 23 is at a position other than the limit position. In this case, processing of moving dancer roller 23 to the limit position is performed.

Specifically, in step S104, unwinding of packaging material 2 from wound body 3 is started. Packaging controller 201 transmits the control signal to unwinding and winding motor 35 so as to rotationally drive mounting target unit 21 in the direction in which packaging material 2 is unwound from wound body 3.

Subsequently, whether limit position sensor 27 is on is determined in step S105. When it is determined that limit position sensor 27 is not on and thereby dancer roller 23 is not located at the limit position (NO in step S105), the determination in step S105 is repeated until it is detected that limit position sensor 27 is on, and the unwinding of packaging material 2 is continued during that time. When it is detected that limit position sensor 27 is turned on (YES in step S105), the processing proceeds to step S106, and the unwinding of packaging material 2 from wound body 3 is ended. Packaging controller 201 transmits the control signal in order to stop unwinding and winding motor 35.

When it is determined in the determination of step S103 that limit position sensor 27 is on (YES in step S103), dancer roller 23 is at the limit position. When the unwinding of packaging material 2 is ended in step S106, dancer roller 23 is at the limit position. When it is detected that dancer roller 23 is at the limit position, the processing proceeds to step S107 through a connector 1, and the winding of packaging material 2 onto wound body 3 is started. Packaging controller 201 transmits the control signal to unwinding and winding motor 35 so as to rotationally drive mounting target unit 21 in the direction in which packaging material 2 is wound onto wound body 3.

Subsequently, whether fixed position sensor 28 is on is determined in step S108. When it is determined that fixed position sensor 28 is not on and thereby dancer roller 23 is not located at the fixed position (NO in step S108), the determination in step S108 is repeated until it is detected that fixed position sensor 28 is turned on.

When it is detected that fixed position sensor 28 is turned on (YES in step S108), whether fixed position sensor 28 is off is determined in step S109. When it is determined that fixed position sensor 28 is not off but on and thereby dancer roller 23 is located at the fixed position (NO in step S109), the determination in step S109 is repeated until it is detected that fixed position sensor 28 is turned off.

The winding of packaging material 2 is continued while the determinations in steps S108 and S109 are repeated. When it is determined that fixed position sensor 28 is turned off and thereby dancer roller 23 is displaced from the fixed position (YES in step S109), the processing proceeds to step S110 and the winding of packaging material 2 onto wound body 3 is ended. Packaging controller 201 transmits the control signal in order to stop unwinding and winding motor 35.

When the winding of packaging material 2 onto wound body 3 is ended, dancer roller 23 moves beyond the fixed position from the limit position, and dancer roller 23 moves between the fixed position and the retracted position. The processing of moving dancer roller 23 to the fixed position again is performed from this state.

Specifically, the unwinding of packaging material 2 from wound body 3 is started in step S111. Packaging controller 201 transmits the control signal to unwinding and winding motor 35 so as to rotationally drive mounting target unit 21 in the direction in which packaging material 2 is unwound from wound body 3.

Subsequently, whether fixed position sensor 28 is on is determined in step S112. When it is determined that fixed position sensor 28 is not on and thereby dancer roller 23 is not located at the fixed position (NO in step S112), the determination in step S112 is repeated until it is detected that fixed position sensor 28 is turned on, and the unwinding of packaging material 2 is continued during that time. When it is detected that fixed position sensor 28 is turned on (YES in step S112), the processing proceeds to step S113, and the unwinding of packaging material 2 from wound body 3 is ended. Packaging controller 201 transmits the control signal in order to stop unwinding and winding motor 35.

In this manner, the fixed position return operation of the dancer roller during the initial operation is performed. Then, the fixed position return operation is ended ("end" in FIG. 16).

Figure 17:
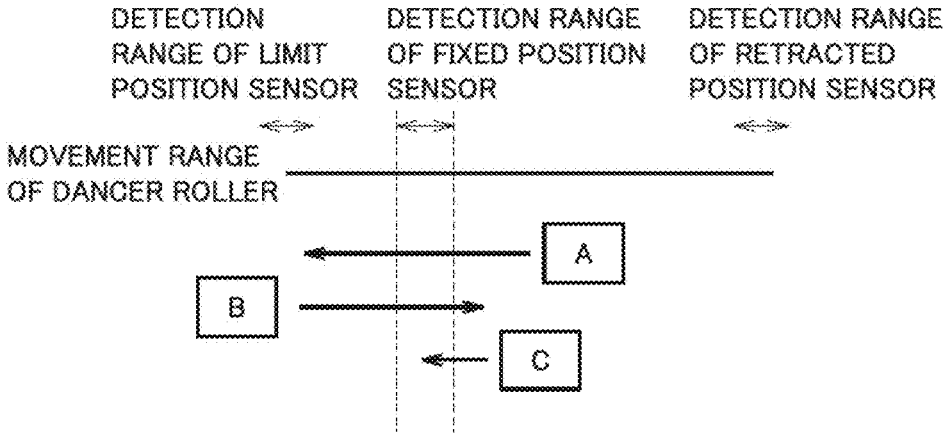
FIG. 17 is a schematic diagram illustrating movement of the dancer roller while the fixed position return operation of the dancer roller is executed during the initial operation.

FIG. 17 is a schematic diagram illustrating the movement of dancer roller 23 while the fixed position return operation of dancer roller 23 is executed during the initial operation. In FIG. 17, a line segment extending in the left-right direction indicates the movement range of dancer roller 23. Three double-headed arrows indicate a detection range of limit position sensor 27, a detection range of fixed position sensor 28, and a detection range of retracted position sensor 29 in order from the left to the right in FIG. 17. As described above, limit position sensor 27, fixed position sensor 28, and retracted position sensor 29 are turned on by detecting the magnetic force of the magnet attached to main arm 40. For this reason, each of limit position sensor 27, fixed position sensor 28, and retracted position sensor 29 has the detection range of a predetermined width.

In steps S104 to S106 described above, dancer roller 23 moves to the limit position as indicated by an arrow denoted by a reference character A in FIG. 17. In steps S107 to S110, dancer roller 23 moves beyond the fixed position from the limit position as indicated by an arrow denoted by a reference character B in FIG. 17. In steps S111 to S113, dancer roller 23 moves to the fixed position as indicated by an arrow denoted by a reference character C in FIG. 17.

When unwinding and winding motor 35 is stopped by the detection of the on state of fixed position sensor 28, the movement of dancer roller 23 is generated even after fixed position sensor 28 is turned on for the time of deceleration until unwinding and winding motor 35 is stopped. Because fixed position sensor 28 has the predetermined detection range, the position where dancer roller 23 stops when dancer roller 23 is moved to the fixed position while wound body 3 is unwound and the position where dancer roller 23 stops when dancer roller 23 is moved to the fixed position while wound body 3 is wound are possibly shifted from each other.

In the embodiment, dancer roller 23 is stopped at the fixed position by unwinding wound body 3. The position where dancer roller 23 is stopped can be aligned constant by setting the direction of the movement of dancer roller 23 to one direction when dancer roller 23 is stopped at the fixed position. Consequently, the fixed position return operation of dancer roller 23 can be reliably executed.

The rotation speed of wound body 3 is set to the rotation speed set based on the remaining amount information of packaging material 2 acquired from recording medium 3*b*, which is set in step S2 of FIG. 14 in the unwinding of wound body 3 in steps S104 to S106, the winding of wound body 3 in steps S107 to S110, and the unwinding of wound body 3 in steps S111 to S113. The fixed position return operation is executed such that unwinding and winding motor 35 is driven to rotate wound body 3 at the rotation speed set based on the remaining amount information of packaging material 2.

Consequently, the necessity of the rotation of unwinding and winding motor 35 at the minimum speed is eliminated during the fixed position return operation, and unwinding and winding motor 35 can be rotated at an appropriate rotation speed. In addition, the necessity of the processing of determining the remaining amount of packaging material 2 is eliminated. Accordingly, the fixed position return operation can be executed in a short time, and the time required for the return operation during the initial operation can be shortened.

The fixed position return operation of dancer roller 23 during the initial operation also serves as sensor check operation checking whether an abnormality exists in fixed position sensor 28 and limit position sensor 27. Dancer roller 23 is moved to the limit position in steps S103 to S106, and dancer roller 23 is moved to the fixed position in steps SS107 to S113. Whether the movement of dancer roller 23 is detected by fixed position sensor 28 and limit position sensor 27 is checked, so that the sensor check operation can be reliably executed.

Figure 18:
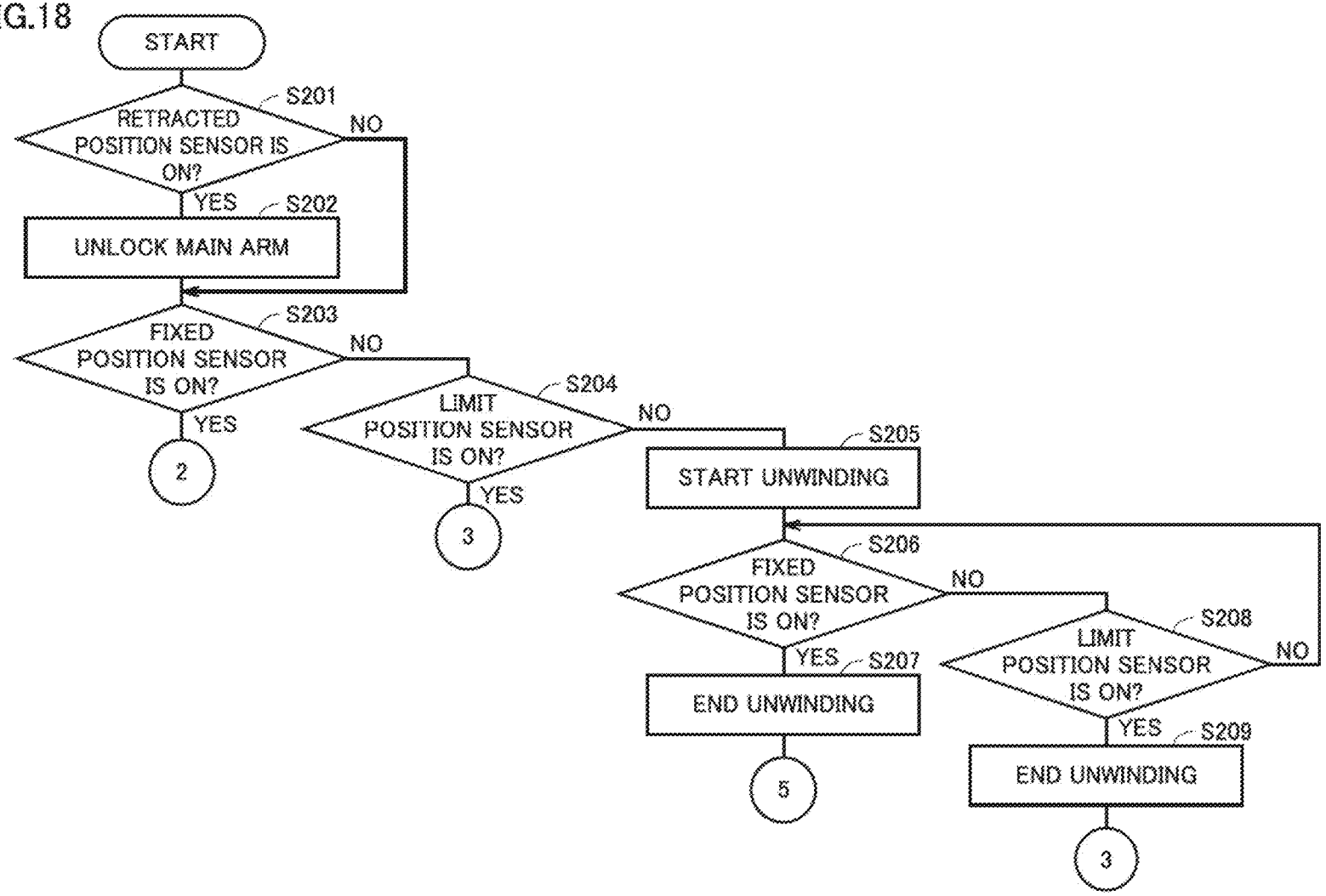
FIG. 18 is a flowchart illustrating the fixed position return operation of the dancer roller after mounting of the wound body.
Figure 19:
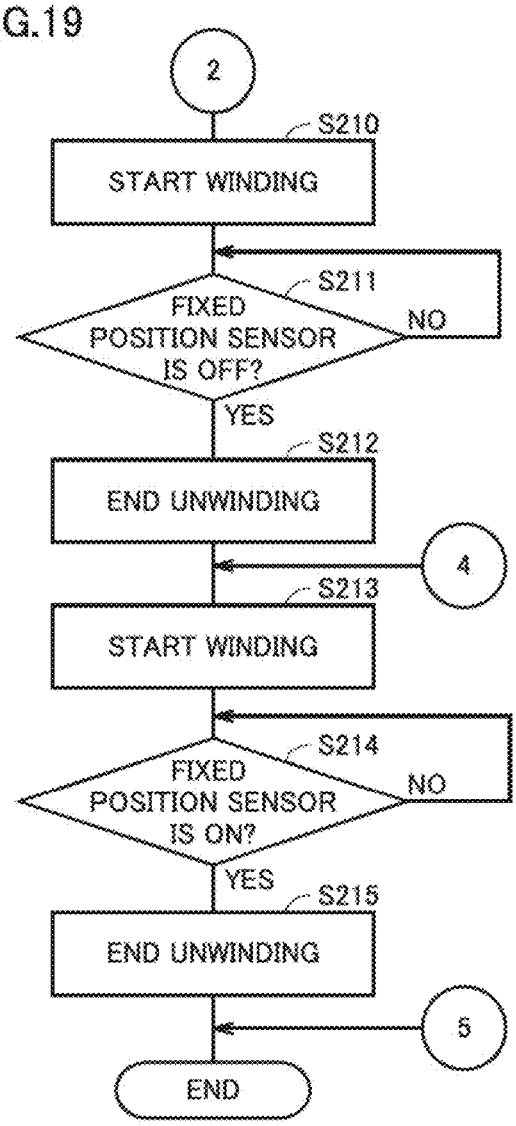
FIG. 19 is a flowchart illustrating the fixed position return operation of the dancer roller after the mounting of the wound body.
Figure 20:
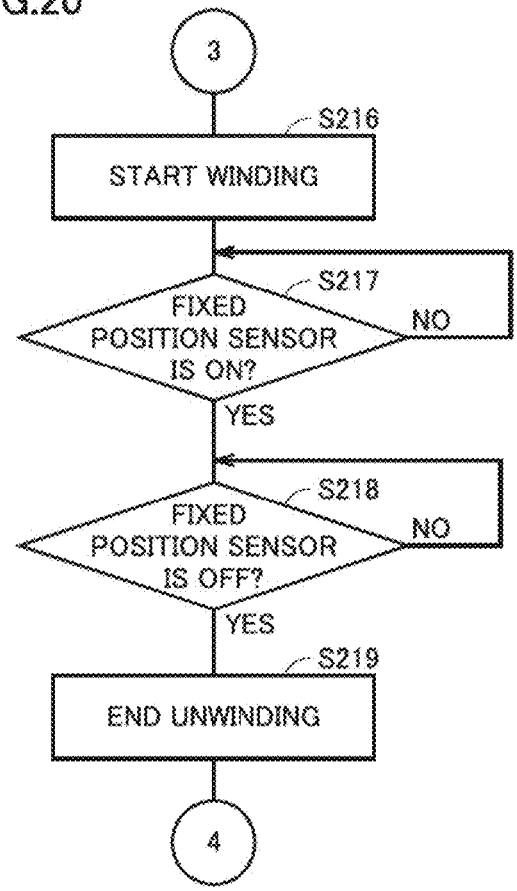
FIG. 20 is a flowchart illustrating the fixed position return operation of the dancer roller after the mounting of the wound body.

FIGS. 18, 19, and 20 are flowcharts illustrating the fixed position return operation of dancer roller 23 after the mounting of the wound body. When a predetermined key is operated after wound body 3 is mounted on mounting target unit 21 in replacing wound body 3, the fixed position return operation of dancer roller 23 is executed.

First, whether the retracted position sensor 29 is on is determined in step S201. Main arm 40 is unlocked in step S202. Because the pieces of processing of steps S201, S202 are similar to the pieces of processing of steps S101, S102 described with reference to FIG. 15, the description will be omitted.

Subsequently, whether fixed position sensor 28 is on is determined in step S203. Packaging controller 201 determines whether fixed position sensor 28 is on based on the presence or absence of the detection signal indicating that fixed position sensor 28 is on. When the detection signal is input from fixed position sensor 28 and thereby it is determined that fixed position sensor 28 is on (YES in step S203), dancer roller 23 is at the fixed position, and the processing of further aligning the position where dancer roller 23 is stopped is performed.

Specifically, the processing proceeds to step S210 through a connector 2, and the winding of packaging material 2 onto wound body 3 is started. Since the processing of step S210 is similar to the processing of step S107 described with reference to FIG. 16, the description will be omitted.

Subsequently, whether fixed position sensor 28 is off is determined in step S211. The winding of packaging material 2 onto wound body 3 is ended in step S212. The unwinding of packaging material 2 from wound body 3 is started in step S213. Whether fixed position sensor 28 is on is determined in step S214. The unwinding of packaging material 2 from wound body 3 is ended in step S215. Because the pieces of processing of steps S211 to S215 are similar to the pieces of processing of steps S109 to S113 described with reference to FIG. 16, the description will be omitted. The positions at which dancer roller 23 stops within the detection range of fixed position sensor 28 can be aligned by unwinding wound body 3 to stop dancer roller 23 at the fixed position.

When it is determined in the determination of step S203 that fixed position sensor 28 is not on and thereby dancer roller 23 is at a position other than the fixed position (NO in step S203), whether limit position sensor 27 is on is determined in step S204. Because the processing of step S204 is similar to step S103 described with reference to FIG. 15, the description will be omitted.

When it is determined that limit position sensor 27 is on (YES in step S204), the processing of moving dancer roller 23 beyond the fixed position from the limit position and further moving to the fixed position is performed.

Specifically, the processing proceeds to step S216 through a connector 3, and winding of packaging material 2 onto wound body 3 is started. Whether fixed position sensor 28 is on is determined in step S217. Whether fixed position sensor 28 is off is determined in step S218. The winding of packaging material 2 onto wound body 3 is ended in step S219. Because the pieces of processing of steps S216 to S219 are similar to the pieces of processing of steps S107 to S110 described with reference to FIG. 16, the description will be omitted. Subsequently, the pieces of processing of steps S213 to S215 are performed through a connector 4.

When it is determined in the determination of step S204 that limit position sensor 27 is not on and thereby dancer roller 23 is at a position other than the fixed position and the limit position (NO in step S204), the unwinding of packaging material 2 from wound body 3 is started in step S205. Packaging controller 201 transmits the control signal to unwinding and winding motor 35 so as to rotationally drive mounting target unit 21 in the direction in which packaging material 2 is unwound from wound body 3.

Subsequently, whether fixed position sensor 28 is on is determined in step S206. When it is determined that fixed position sensor 28 is not on and thereby dancer roller 23 is not at the fixed position (NO in step S206), whether limit position sensor 27 is on is determined in step S208. When it is determined that limit position sensor 27 is not on and thereby dancer roller 23 is still at a position other than the fixed position and the limit position, the processing returns to the determination of step S206. The determinations of steps S206 and S207 are repeated until either fixed position sensor 28 or limit position sensor 27 is turned on, and the unwinding of the packaging material is continued during that period.

When it is detected in the determination of step S206 that fixed position sensor 28 is turned on (YES in step S206), the processing proceeds to step S207, and the unwinding of packaging material 2 from wound body 3 is ended. In this case, when the fixed position return operation is started, dancer roller 23 is located between the fixed position and the retreated position, dancer roller 23 is moved in the direction toward the limit position by unwinding wound body 3, and dancer roller 23 is stopped at the fixed position. As a result, because the positions at which dancer roller 23 is stopped are aligned, the processing proceeds to FIG. 19 through a connector 5, and the processing ends without moving dancer roller 23 to the limit position.

When it is detected in the determination of step S208 that limit position sensor 27 is turned on (YES in step S208), the processing proceeds to step S209 and the unwinding of packaging material 2 from wound body 3 is ended. In this case, when the fixed position return operation is started, dancer roller 23 is located between the limit position and the fixed position, and dancer roller 23 is moved in the direction toward the limit position by unwinding wound body 3 to stop dancer roller 23 at the limit position. Accordingly, the pieces of the processing of steps S216 to S219 and subsequently the pieces of the processing of steps S213 to S215 described above are performed, wound body 3 is unwound to stop dancer roller 23 at the fixed position.

In this manner, the fixed position return operation of dancer roller 23 after the mounting of the wound body is performed. Then, the fixed position return operation is ended ("end" in FIG. 19).

Figure 21:
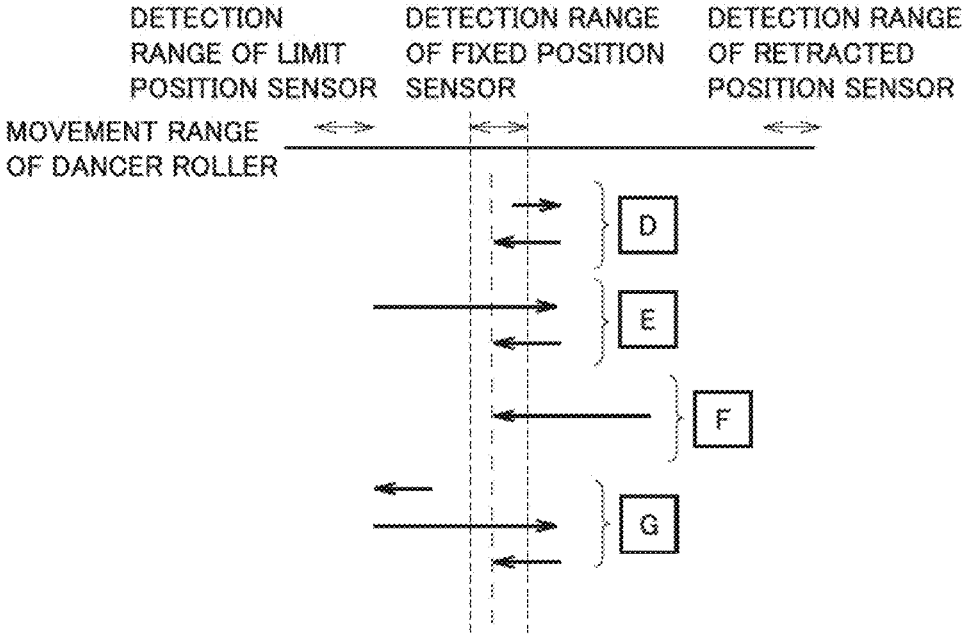
FIG. 21 is a schematic diagram illustrating the movement of the dancer roller while the fixed position return operation of the dancer roller is executed after the mounting of the wound body.

FIG. 21 is a schematic diagram illustrating the movement of dancer roller 23 while the fixed position return operation of dancer roller 23 is executed after the mounting of the wound body. Similarly to FIG. 17, FIG. 21 illustrates the movement range of dancer roller 23 and the detection ranges of limit position sensor 27, fixed position sensor 28, and retracted position sensor 29.

As described in steps S203, S210 to S215 described above, when dancer roller 23 is located at the fixed position at the start of the fixed position return operation, dancer roller 23 temporarily moves from the fixed position toward the retracted position, and returns to the fixed position again as indicated by an arrow denoted by a reference character D in FIG. 21.

As described in steps S204, S216 to S219, S213 to S215, when dancer roller 23 is located at the limit position at the start of the fixed position return operation, dancer roller 23 moves from the limit position beyond the fixed position, and returns to the fixed position again as indicated by an arrow denoted by reference character E in FIG. 21.

As described in steps S205 to S207, when the dancer roller 23 is between the fixed position and the retracted position at the start of the fixed position return operation, the dancer roller 23 moves to the fixed position as indicated by an arrow denoted by a reference character F in FIG. 21.

As described in steps S205, S208 to S209, S216 to S219, S213 to S215, when dancer roller 23 is located between the limit position and the fixed position at the start of the fixed position return operation, dancer roller 23 temporarily moves to the limit position, moves from the limit position beyond the fixed position, and returns to the fixed position as indicated by an arrow denoted by a reference character G in FIG. 21.

In this manner, wound body 3 is unwound to stop dancer roller 23 at the fixed position, and the direction of the movement of dancer roller 23 is determined to be one direction when dancer roller 23 is tried to be stopped at the fixed position. The fixed position return operation of dancer roller 23 can be certainly executed by aligning the stop position of dancer roller 23 constant.

During the unwinding of wound body 3 in steps S205 to S207 and steps S205 to S209, the winding of wound body 3 in steps S210 to S212, the unwinding of wound body 3 in steps S213 to S215, and the winding of wound body 3 in steps S216 to S219, the rotation speed of wound body 3 is set to the rotation speed set based on the remaining amount information of packaging material 2 acquired from recording medium 3*b*, which is set in step S2 of FIG. 14. Unwinding and winding motor 35 is driven to rotate wound body 3 at the rotation speed set based on the remaining amount information of packaging material 2, and the fixed position return operation is executed.

Consequently, the necessity of the rotation of unwinding and winding motor 35 at the minimum speed is eliminated during the fixed position return operation, and unwinding and winding motor 35 can be rotated at an appropriate rotation speed. In addition, the necessity of the processing of determining the remaining amount of packaging material 2 is eliminated. Accordingly, the fixed position return operation can be executed in a short time, and the time required for the return operation after the mounting of the wound body can be shortened.

The fixed position return operation of dancer roller 23 after the mounting of the wound body does not serve as the sensor check operation unlike during the initial operation. In steps 203, 206, when fixed position sensor 28 is on, the return operation is ended without moving dancer roller 23 to the limit position. The time required for the fixed position return operation can be certainly shortened by reducing the movement of dancer roller 23.

Figure 22:
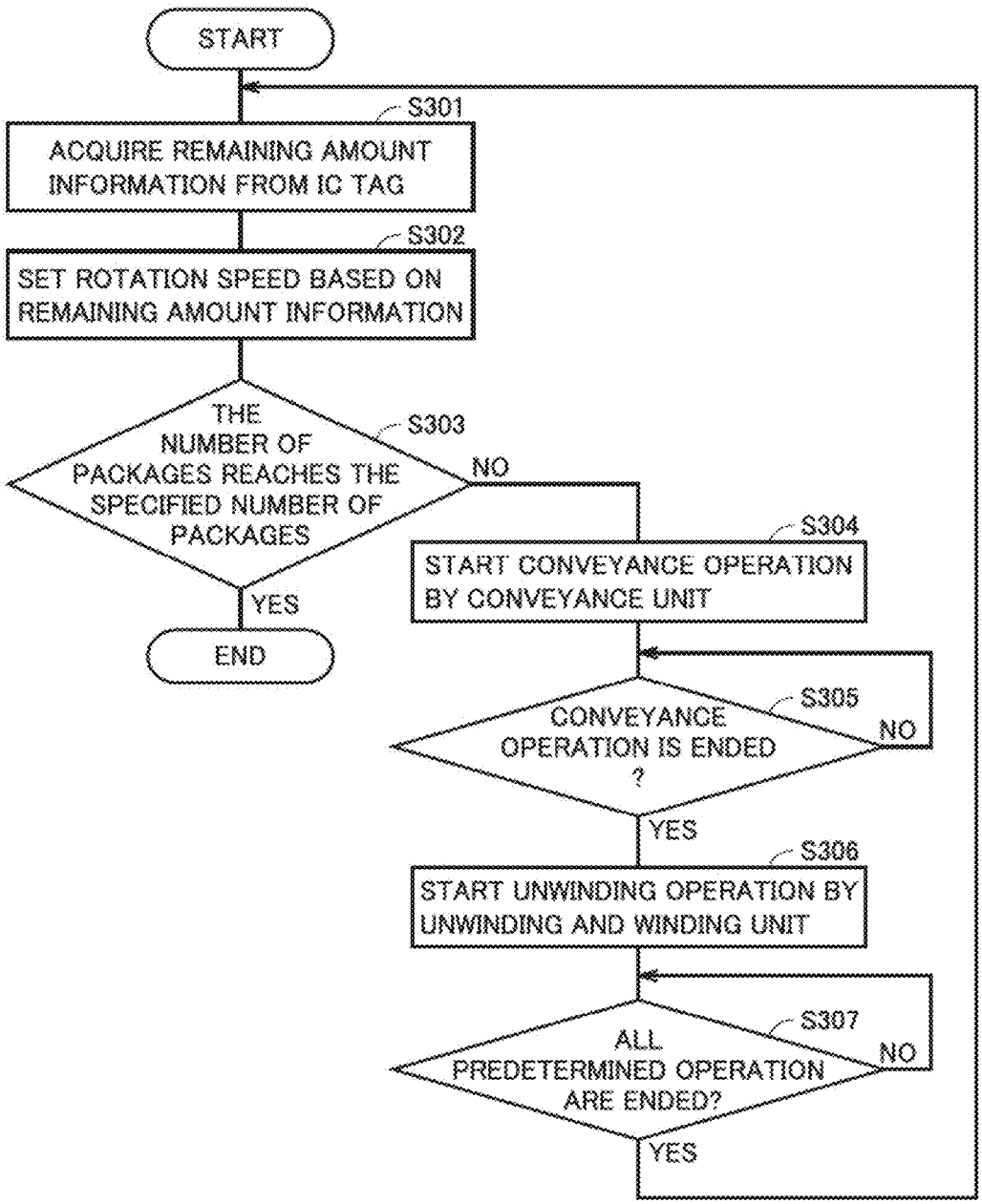
FIG. 22 is a flowchart illustrating operation by the unwinding and winding unit and a conveyance unit in a dispensing operation.

FIG. 22 is a flowchart illustrating the operations performed by the unwinding and winding unit and the conveyance unit in the dispensing operation. As illustrated in FIG. 22, when the dispensing operation of the object to be packaged by packaging device 1 is started, the remaining amount information indicating the remaining amount of packaging material 2 in wound body 3 is acquired from the IC tag in step S301. In step S302, the rotation speed is set based on the remaining amount information. Because the pieces of the processing of steps S301 and S302 are similar to the pieces of the processing of steps S1 and S2 described with reference to FIG. 14, the description will be omitted.

Subsequently, in step S303, it is determined whether the number of packages packaged by packaging device 1 by the current time after the start of the packaging reaches the specified number of packages. When the number of packages does not reach the specified number of packages (NO in step S303), conveyance operation of packaging material 2 by the conveyance unit is started in step S304. Packaging controller 201 transmits the control signal driving conveyance motor 8*m* to conveyance motor 8*m*. During the conveyance operation of packaging material 2, packaging controller 201 transmits the control signal maintaining the stop of unwinding and winding motor 35 to unwinding and winding motor 35. For this reason, packaging material 2 is not unwound from wound body 3.

Subsequently, whether the conveyance operation is ended is determined in step S305. Packaging controller 201 calculates the conveyance distance of packaging material 2 based on a drive amount of conveyance motor 8*m*. When packaging material 2 is conveyed by the length of one package, the conveyance operation of packaging material 2 is ended. Packaging controller 201 transmits the control signal stopping conveyance motor 8*m* to conveyance motor 8*m*. When the conveyance operation of packaging material 2 is ended, dancer roller 23 is moved from the fixed position to the movement position during conveyance. Subsequently, the unwinding operation by unwinding and winding unit is started in step S306.

Figure 23:
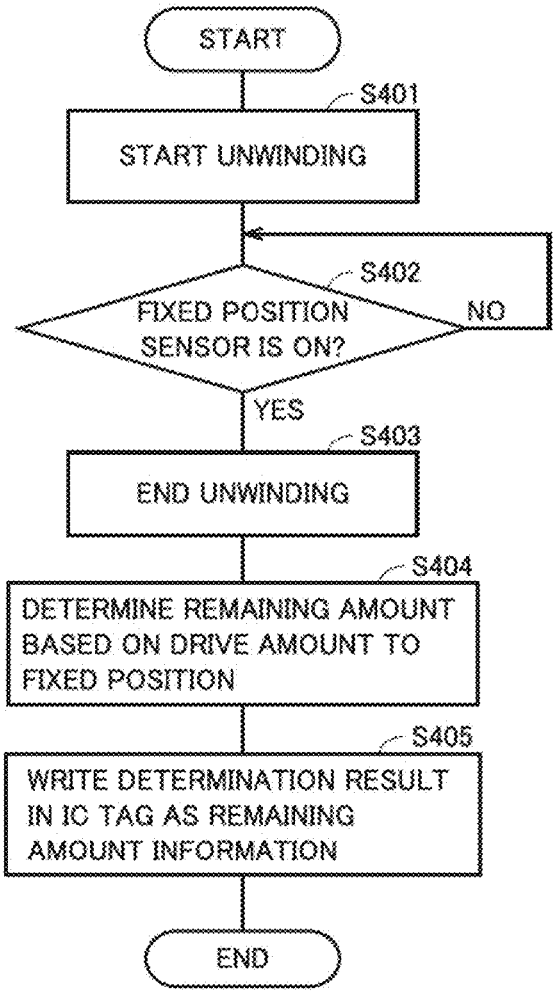
FIG. 23 is a flowchart illustrating a first example of unwinding operation by the unwinding and winding unit.

FIG. 23 is a flowchart illustrating a first example of the unwinding operation by the unwinding and winding unit. FIG. 23 is the flowchart illustrating an example of a subroutine of the unwinding operation performed in step S306.

Referring to FIG. 23, the unwinding of packaging material 2 from wound body 3 is started in step S401. Packaging controller 201 transmits the control signal to unwinding and winding motor 35 so as to rotationally drive mounting target unit 21 in the direction in which packaging material 2 is unwound from wound body 3. At this time, packaging controller 201 rotationally drives unwinding and winding motor 35 at the rotation speed based on the remaining amount information of packaging material 2, which is set in step S302.

Subsequently, whether fixed position sensor 28 is on is determined in step S402. When it is determined that fixed position sensor 28 is not on and thereby dancer roller 23 is not located at the fixed position (NO in step S402), the determination in step S402 is repeated until it is detected that dancer roller 23 is located at the fixed position, and the unwinding of packaging material 2 is continued during that time. When it is determined that dancer roller 23 is located at the fixed position (YES in step S402), the processing proceeds to step S403, and the unwinding of packaging material 2 from wound body 3 is ended. Packaging controller 201 transmits the control signal in order to stop unwinding and winding motor 35.

In the unwinding operation, dancer roller 23 moves from the movement position during conveyance to the fixed position. The movement position during conveyance changes according to the length of one package in conveyance direction DR. The relationship between the length of one package and the movement position during conveyance is previously stored in packaging controller 201. Packaging controller 201 derives a movement distance of dancer roller 23 in the unwinding operation according to the length of one package.

When the unwinding operation is ended, the remaining amount of packaging material 2 in wound body 3 is determined in step S404. The number of steps of the stepping motor is counted from the start of the driving of wound body 3 by unwinding and winding motor 35 in step S401 to the detection of dancer roller 23 at the fixed position in step S402. The winding diameter of packaging material 2 in wound body 3 is determined by counting the number of steps of the stepping motor during the movement of dancer roller 23 from the movement position during conveyance to the fixed position. The remaining amount of packaging material 2 in wound body 3 can be determined by obtaining the winding diameter of packaging material 2 based on the number of steps of unwinding and winding motor 35.

When the winding diameter of packaging material 2 is small, the number of rotations of packaging material 2 necessary for moving dancer roller 23 to a certain distance increases, and the number of steps of the stepping motor increases at this time. When the winding diameter of packaging material 2 is large, the number of rotations of packaging material 2 necessary for moving dancer roller 23 to a certain distance decreases, and the number of steps of the stepping motor decreases at this time. Consequently, the remaining amount of packaging material 2 in wound body 3 can be determined based on the number of steps of unwinding and winding motor 35 by previously storing the relationship between the number of steps of the stepping motor and the remaining amount of packaging material 2 in packaging controller 201.

In step S405, the determination result of the remaining amount of packaging material 2 determined in step S404 is written in the IC tag as the remaining amount information. Read and write unit 3R (FIG. 13) accesses the IC tag provided in core tube 3*a* of wound body 3, namely, recording medium 3*b* (FIG. 2), and writes the remaining amount information in recording medium 3*b*. Thus, the remaining amount information recorded in recording medium 3*b* is updated.

In the first example of FIG. 23, the remaining amount information is written in the IC tag each time the unwinding operation for one package is executed. Then, the unwinding processing is ended ("end" in FIG. 23).

Figure 24:
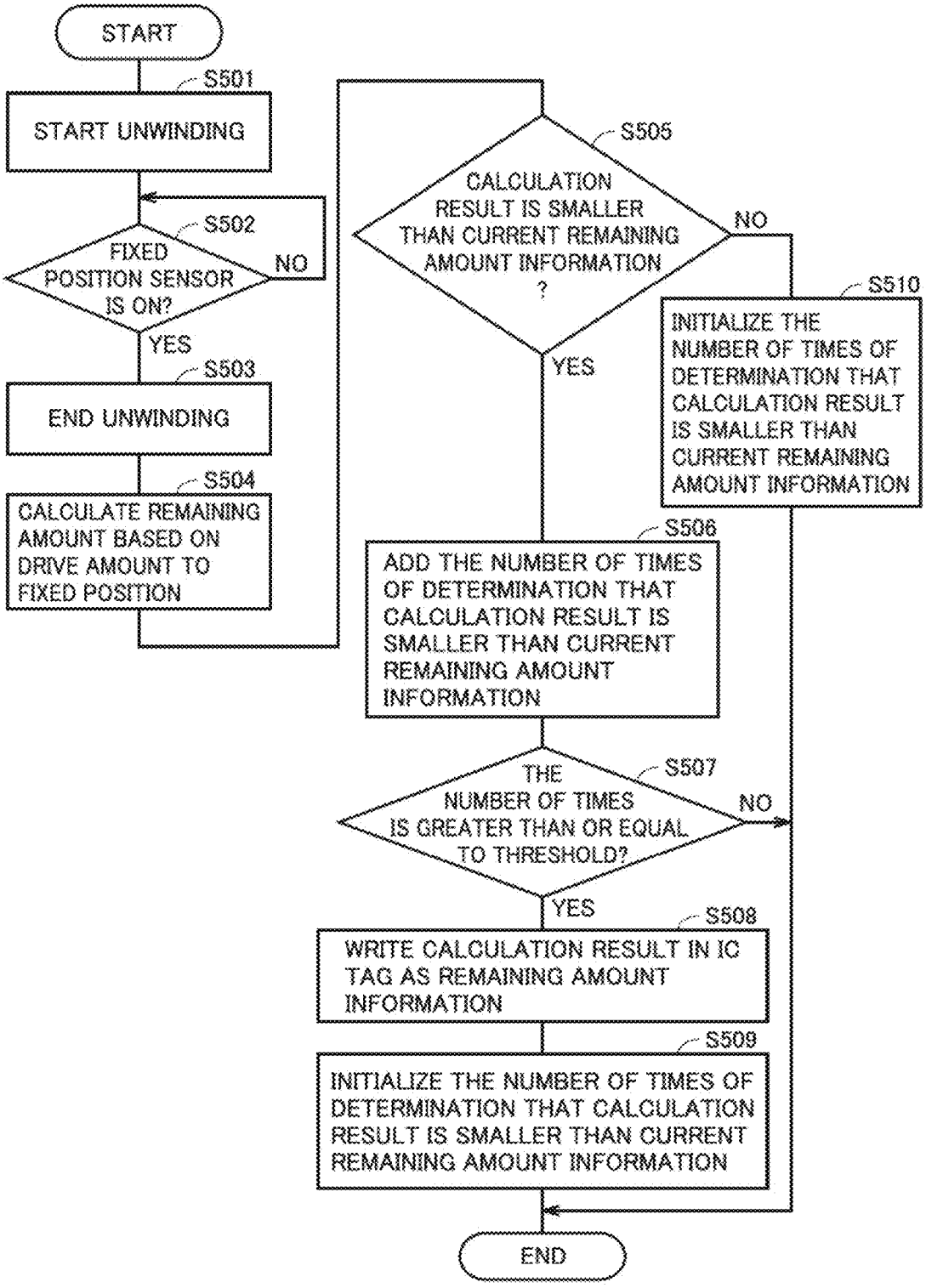
FIG. 24 is a flowchart illustrating a second example of the unwinding operation by the unwinding and winding unit.

FIG. 24 is a flowchart illustrating a second example of the unwinding operation by the unwinding and winding unit. FIG. 24 is the flowchart illustrating another example of the subroutine of the unwinding operation performed in step S306.

Referring to FIG. 24, the unwinding of packaging material 2 from wound body 3 is started in step S501. Packaging controller 201 transmits the control signal to unwinding and winding motor 35 so as to rotationally drive mounting target unit 21 in the direction in which packaging material 2 is unwound from wound body 3. At this time, packaging controller 201 rotationally drives unwinding and winding motor 35 at the rotation speed based on the remaining amount information of packaging material 2, which is set in step S302.

Subsequently, whether fixed position sensor 28 is on is determined in step S502. When it is determined that fixed position sensor 28 is not on and thereby dancer roller 23 is not located at the fixed position (NO in step S502), the determination in step S502 is repeated until it is detected that dancer roller 23 is located at the fixed position, and the unwinding of packaging material 2 is continued during that time. When it is determined that dancer roller 23 is located at the fixed position (YES in step S502), the processing proceeds to step S503, and the unwinding of packaging material 2 from wound body 3 is ended. Packaging controller 201 transmits the control signal in order to stop unwinding and winding motor 35.

When the unwinding operation is ended, the remaining amount of packaging material 2 in wound body 3 is calculated in step S504. The number of steps of the stepping motor is counted from the start of the driving of wound body 3 by unwinding and winding motor 35 in step S501 to the detection of dancer roller 23 at the fixed position in step S502. The remaining amount of packaging material 2 in wound body 3 can be calculated based on the number of steps of the stepping motor during the movement of dancer roller 23 from the movement position during conveyance to the fixed position.

Subsequently, in step S505, the calculation result of the remaining amount of packaging material 2 calculated in step S504 is compared with the current remaining amount information, and it is determined whether the calculation result of the remaining amount of packaging material 2 is smaller than the current remaining amount information. That is, it is determined whether the remaining amount of packaging material 2 calculated this time is smaller than the remaining amount of packaging material 2, which is acquired from recording medium 3*b* in step S301 and recorded in recording medium 3*b* at this time.

When it is determined that the calculation result of the remaining amount of packaging material 2 is smaller than the current remaining amount information (YES in step S405), one is added to the number of times of the determination that the calculation result of the remaining amount of packaging material 2 is smaller than the current remaining amount information in step S506. More specifically, when the number of times of the determination that the calculation result of the remaining amount of packaging material 2 is smaller than the current remaining amount information at the time of step S405 is N (N is an integer of zero or more) times, the number of times is set to (N+1) times in step S506. For example, when the number of times of the determination that the calculation result of the remaining amount of packaging material 2 is smaller than the current remaining amount information at the time of step S505 is twice, the number of times is set to three times in step S506.

Subsequently, in step S507, it is determined whether the number of times after the addition in step S506 is greater than or equal to a threshold. When it is determined that the number of times is greater than or equal to the threshold (YES in step S507), the processing proceeds to step S508, and the determination result of the remaining amount of packaging material 2 determined in step S504 is written in the IC tag as the remaining amount information. For example, when the threshold used for the determination in step S507 is five, and when it can be determined for five consecutive times that the calculation result of the remaining amount of packaging material 2 is smaller than the current remaining amount information, the remaining amount information is written in recording medium 3*b*, and the remaining amount information recorded in recording medium 3*b* is updated.

The remaining amount information may be updated by setting the latest calculation result of the remaining amount of packaging material 2 calculated in step S504 to the remaining amount determination result. For example, when the threshold used for the determination in step S507 is five, and when it can be determined for five consecutive times that the calculation result of the remaining amount of packaging material 2 is smaller than the current remaining amount information, the fifth calculation result may be recorded in recording medium 3*b* as the new remaining amount information.

Alternatively, the remaining amount information may be updated using the maximum calculation result among a plurality of calculation results of the remaining amount of packaging material 2 calculated in step S504 as the remaining amount information. For example, when the threshold used for the determination in step S507 is five, and when it can be determined for five consecutive times that the calculation result of the remaining amount of packaging material 2 is smaller than the current remaining amount information, the largest calculation result among the five calculation results may be recorded in recording medium 3*b* as the new remaining amount information.

Alternatively, the remaining amount information may be updated using the most frequent calculation result among the plurality of calculation results of the remaining amount of packaging material 2 calculated in step S504 as the remaining amount information. For example, when the threshold used for the determination in step S507 is five, when it can be determined for five consecutive times that the calculation result of the remaining amount of packaging material 2 is smaller than the current remaining amount information, and when four of the five calculation results have the same value but the other one is different, the same value as the four calculation results excluding one calculation result having the different value may be recorded in recording medium 3*b* as the new remaining amount information.

Alternatively, when a plurality of stages is set to the remaining amount of packaging material 2, the remaining amount information may be updated by decreasing the remaining amount by one stage. For example, when the threshold used for the determination in step S507 is five, and when it can be determined for five consecutive times that the calculation result of the remaining amount of packaging material 2 is smaller than the remaining amount at the current stage, the remaining amount may be decreased by one stage and recorded in recording medium 3*b* as new remaining amount information regardless of the five calculation results.

In this manner, the remaining amount information recorded in recording medium 3*b* is updated. The number of times of the determination that the calculation result of the remaining amount of packaging material 2 is smaller than the current remaining amount information is initialized in step S509. That is, the number of times is set to zero. Then, the unwinding operation is ended.

When the number of times is less than the threshold in the determination of step S507 (NO in step S507), the unwinding operation is ended without updating the remaining amount information.

When it is determined in step S505 that the calculation result of the remaining amount of packaging material 2 is greater than or equal to the current remaining amount information (NO in step S505), the processing proceeds to step S510 to initialize the number of times of the determination that the calculation result of the remaining amount of packaging material 2 is smaller than the current remaining amount information. That is, the number of times is set to zero. Then, the unwinding operation is ended without updating the remaining amount information.

Alternatively, when it is determined in the determination of step S505 that the calculation result of the remaining amount of packaging material 2 is greater than or equal to the current remaining amount information, the unwinding operation may be ended without performing anything. That is, when it is determined NO in step S505, step S510 in FIG. 24 may be skipped, and the unwinding operation may be ended as it is. In this case, the number of times of the determination that the calculation result of the remaining amount of packaging material 2 is smaller than the current remaining amount information is not initialized even when it is determined that the calculation result of the remaining amount of packaging material 2 is greater than or equal to the current remaining amount information. As a result, the remaining amount information is updated when the number of times the calculation result of the remaining amount of packaging material 2 is determined to be smaller than the current remaining amount information is accumulated to be greater than or equal to the threshold.

For example, when the threshold used for the determination in step S507 is five, when it is determined for four consecutive times that the calculation result of the remaining amount of packaging material 2 is smaller than the current remaining amount information, when it is determined in the fifth determination that the calculation result of the remaining amount of packaging material 2 is larger than the current remaining amount information, and when it is determined in the sixth determination that the calculation result of the remaining amount of packaging material 2 is smaller than the current remaining amount information, the remaining amount information recorded in recording medium 3*b* is updated because the number of times of the determination that the calculation result of the remaining amount of packaging material 2 is smaller than the current remaining amount information is accumulated to be greater than or equal to the threshold.

In the second example of FIG. 24, the remaining amount information is written in the IC tag only when the determination result of the remaining amount changes. Then, the unwinding processing is ended ("end" in FIG. 24).

Figure 25:
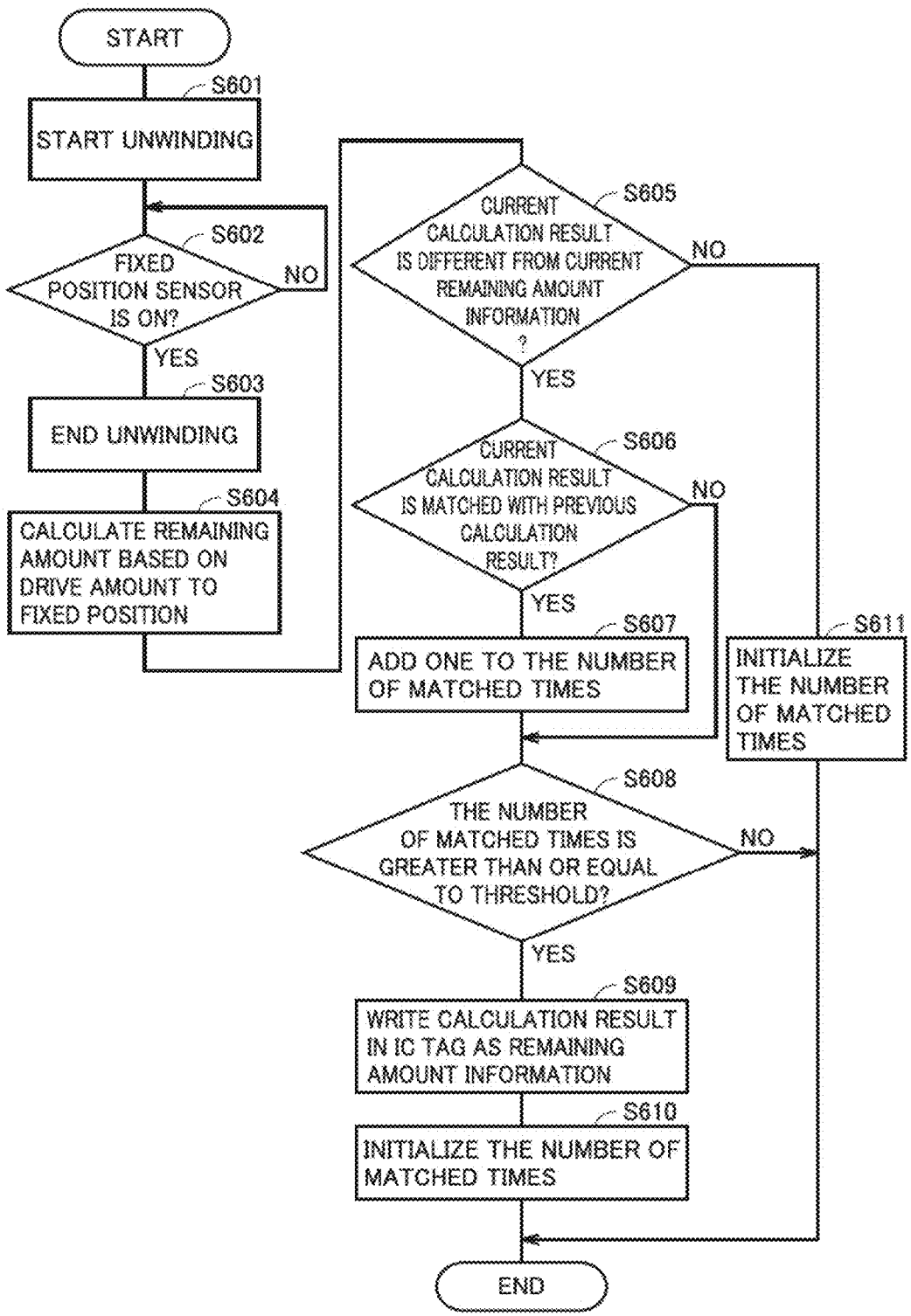
FIG. 25 is a flowchart illustrating a third example of the unwinding operation by the unwinding and winding unit.

FIG. 25 is a flowchart illustrating a third example of the unwinding operation by the unwinding and winding unit. FIG. 25 is the flowchart illustrating still another example of the subroutine of the unwinding operation performed in step S306.

In steps S601 to S604 of FIG. 25, the same pieces of the processing as steps S501 to S504 described with reference to FIG. 24 is performed.

After the remaining amount of packaging material 2 in wound body 3 is calculated, in step S605, the calculation result of the remaining amount of packaging material 2 calculated in step S604 is compared with the current remaining amount information, and it is determined whether the calculation result of the remaining amount of packaging material 2 is different from the current remaining amount. That is, it is determined whether the remaining amount of packaging material 2 recorded in recording medium 3*b* at this point of time acquired from recording medium 3*b* in step S301 is different from the remaining amount of packaging material 2 calculated this time.

When it is determined that the calculation result of the remaining amount of packaging material 2 is different from the current remaining amount information (YES in step S605), in step S606, it is determined whether the calculation result of the remaining amount of packaging material 2 calculated in step S604 is matched with the calculation result of the remaining amount of packaging material 2 calculated in the previous unwinding operation.

When it is determined that the calculation result of the remaining amount of packaging material 2 is matched with the previous calculation result (YES in step S606), in step S607, one is added to the number of times of the determination that the calculation result of the remaining amount of packaging material 2 is matched with the previous calculation result. More specifically, when the number of times of the determination that the calculation result of the remaining amount of packaging material 2 is matched with the previous calculation result at the time of step S606 is N (N is an integer of zero or more) times, the number of times is set to (N+1) times in step S607. For example, when the determination that the calculation result of the remaining amount of packaging material 2 is matched with the previous calculation result at the time of step S606 is twice, the number of times is set to three times in step S607.

In the determination of step S606, when it is determined that the calculation result of the remaining amount of packaging material 2 is not matched with the previous calculation result (NO in step S606), the processing of adding the number of times of step S607 is skipped.

Subsequently, in step S608, it is determined whether the number of times after the addition in step S607 is greater than or equal to a threshold. When it is determined that the number of times is greater than or equal to the threshold (YES in step S608), the processing proceeds to step S609, and the calculation result of the remaining amount of packaging material 2 calculated in step S504 is recorded in recording medium 3*b* as the new remaining amount information. For example, when the threshold used for the determination in step S608 is five, and when it can be determined for five consecutive times that the calculation result of the remaining amount of packaging material 2 is matched with the previous calculation result, the fifth calculation result is written in recording medium 3*b* as the new remaining amount information, and the remaining amount information recorded in recording medium 3*b* is updated.

In step S610, the number of times of the determination that the calculation result of the remaining amount of packaging material 2 is matched with the previous calculation result is initialized. That is, the number of times is set to zero. Then, the unwinding operation is ended.

When it is determined in step S608 that the number of times is less than the threshold (NO in step S608), the unwinding operation is ended without reflecting the calculation result of the remaining amount of packaging material 2 in the remaining amount determination result.

In the determination of step S605, when it is determined that the calculation result of the remaining amount of packaging material 2 is the same as the current remaining amount information (NO in step S605), the processing proceeds to step S611 to initialize the number of times of the determination that the calculation result of the remaining amount of packaging material 2 is matched with the previous calculation result. That is, the number of times is set to zero. Then, the unwinding operation is ended without reflecting the calculation result of the remaining amount of packaging material 2 in the remaining amount information.

Also in the third example illustrated in FIG. 25, the remaining amount information is written in the IC tag only when the determination result of the remaining amount changes. Then, the unwinding processing is ended ("end" in FIG. 25).

Returning to FIG. 22, when the unwinding operation in step S306 is ended, subsequently in step S307, it is determined whether all the predetermined operations such as the thermal fusion, the printing, and the formation of the perforation and cutting described above to be performed while packaging material 2 is stopped by the conveyance unit are ended. The determination in step S307 is repeated until all the predetermined operations are ended.

When all the predetermined operations are ended (YES in step S307), the processing returns to step S301. After the processing of acquiring the remaining amount information of packaging material 2 in step S301 and the processing of setting the rotation speed in step S302, it is determined again in step S303 whether the number of packages packaged up to the current time reaches the specified number of packages. The conveyance of packaging material 2 and the unwinding of packaging material 2 from wound body 3 are repeated according to steps S304 to S307 until the number of packages packaged by packaging device 1 reaches the specified number of packages. When it is determined that the number of packages reaches the specified number of packages (YES in step S303), a series of dispensing operations by the unwinding and winding unit and the conveyance unit is ended ("end" in FIG. 22).

The setting of the rotation speed based on the remaining amount information of packaging material 2 in steps 301, S302 may be executed only at the beginning of the dispensing operation. That is, the series of pieces of processing related to the dispensing operation may be performed so as to return to the determination in step S303 when it is determined in step S307 that all the predetermined operations are ended.

Packaging device 1 of the embodiment calculates the movement distance of dancer roller 23 based on the detection result of the position detector, and the drive amount of unwinding and winding motor 35 during the movement of dancer roller 23 is measured by counting the number of steps of unwinding and winding motor 35 that is the stepping motor. The remaining amount of packaging material 2 in wound body 3 is calculated from the drive amount of unwinding and winding motor 35 with respect to the moving amount of dancer roller 23.

The remaining amount of packaging material 2 is calculated using the position detector provided to detect that dancer roller 23 is located at the fixed position or the limit position and unwinding and winding motor 35 that generates the driving force to rotate wound body 3 and unwind packaging material 2 from wound body 3. The remaining amount of packaging material 2 in wound body 3 can be calculated using only the component having another use, in other words, without adding the dedicated component calculating the remaining amount of packaging material 2. Thus, the configuration of packaging device 1 can be simplified.

When packaging material 2 sticks to wound body 3 due to static electricity or the like, packaging material 2 may not be unwound from rotating wound body 3. When the amount of packaging material 2 unwound from wound body 3 is smaller than the proper amount, the drive amount of unwinding and winding motor 35 moving dancer roller 23 by a predetermined distance becomes large, and the calculation result of the remaining amount of packaging material 2 becomes smaller than the actual remaining amount. When the remaining amount of packaging material 2 is determined to be small to increase the rotation speed of unwinding and winding motor 35 based on the calculation result smaller than the actual remaining amount of packaging material 2, wound body 3 may rotate at the excessive speed, which leads to the step-out of the stepping motor, loosening of packaging material 2, and the like.

For this reason, in packaging device 1 of the embodiment, the remaining amount determination result is updated based on the plurality of calculation results. Even when it is detected once that the number of rotations of unwinding and winding motor 35 during the calculation of the remaining amount of packaging material 2 is large and that the remaining amount of packaging material 2 is small, the calculation result of the remaining amount of packaging material 2 at that time is not used as the remaining amount determination result, but the remaining amount determination result is updated when it can be determined a plurality of times that the remaining amount of packaging material 2 is small. In this way, the temporary variation of the calculation result of the remaining amount of packaging material 2 is not reflected in the remaining amount determination result, thus the detection accuracy of the remaining amount of packaging material 2 can be improved. Accordingly, the occurrence of an event in which wound body 3 is rotated at the excessive speed with respect to the actual remaining amount of packaging material 2 can be suppressed.

Even when the amount of packaging material 2 unwound from wound body 3 is small due to the sticking of packaging material 2 to wound body 3 or the like, when the sticking of packaging material 2 is eliminated, the winding returns to the proper winding according to the rotation of wound body 3 to calculate the proper remaining amount of packaging material 2.

In the update of the remaining amount information of packaging material 2, the update is performed such that the remaining amount of packaging material 2 in wound body 3 is reduced. Because packaging material 2 is unwound from wound body 3 as the dispensing operation is executed, the remaining amount of packaging material 2 that is newly written is always smaller than the remaining amount of packaging material 2 already recorded in recording medium 3*b*.

Figure 26:
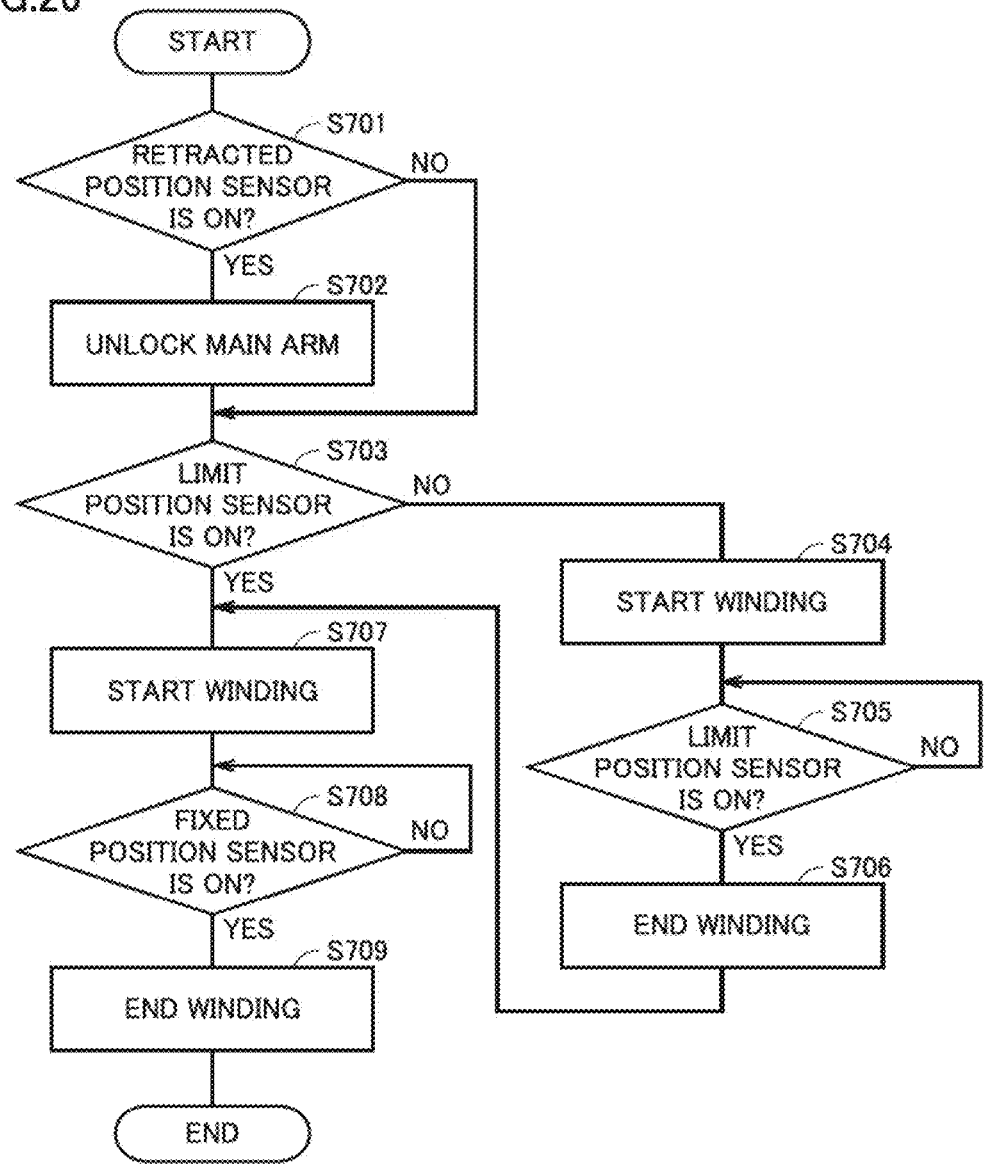
FIG. 26 is a flowchart illustrating another example of the fixed position return operation of the dancer roller during the initial operation.
Figure 27:
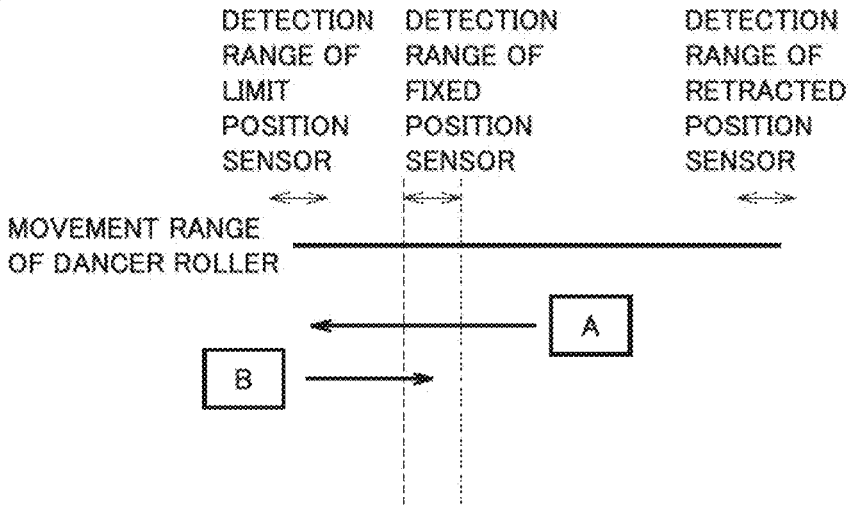
FIG. 27 is a schematic diagram illustrating the movement of the dancer roller while another example of the fixed position return operation of the dancer roller is executed during the initial operation.

FIG. 26 is a flowchart illustrating another example of the fixed position return operation of dancer roller 23 during the initial operation. FIG. 27 is a schematic diagram illustrating the movement of dancer roller 23 while another example of the fixed position return operation of dancer roller 23 is executed during the initial operation.

Another example of the fixed position return operation of dancer roller 23 during the initial operation in FIGS. 26 and 27 is different from the example in FIGS. 15 to 17 in the movement of dancer roller 23 when dancer roller 23 is stopped at the fixed position. In steps S701 to S708, the same pieces of processing as steps S101 to S108 in FIGS. 15 and 16 are performed.

When it is detected in step S708 that fixed position sensor 28 is turned on (YES in step S108), in step S709, the winding of packaging material 2 onto wound body 3 is ended. Instead of moving dancer roller 23 beyond the fixed position as in the example of FIG. 16, packaging material 2 is wound to stop dancer roller 23 at the fixed position.

In the example of FIG. 26, the pieces of processing of steps S109, S111 to S113 in FIG. 16 are omitted. As compared with FIG. 17, in FIG. 27, dancer roller 23 is stopped at the time point when dancer roller 23 reaches the fixed position from the limit position as indicated by the arrow denoted by reference character B, and dancer roller 23 is not moved correspondingly to the arrow denoted by reference character C in FIG. 17. As described above, the movement distance of dancer roller 23 is shortened, so that the fixed position return operation can be ended in a shorter time.

Figure 28:
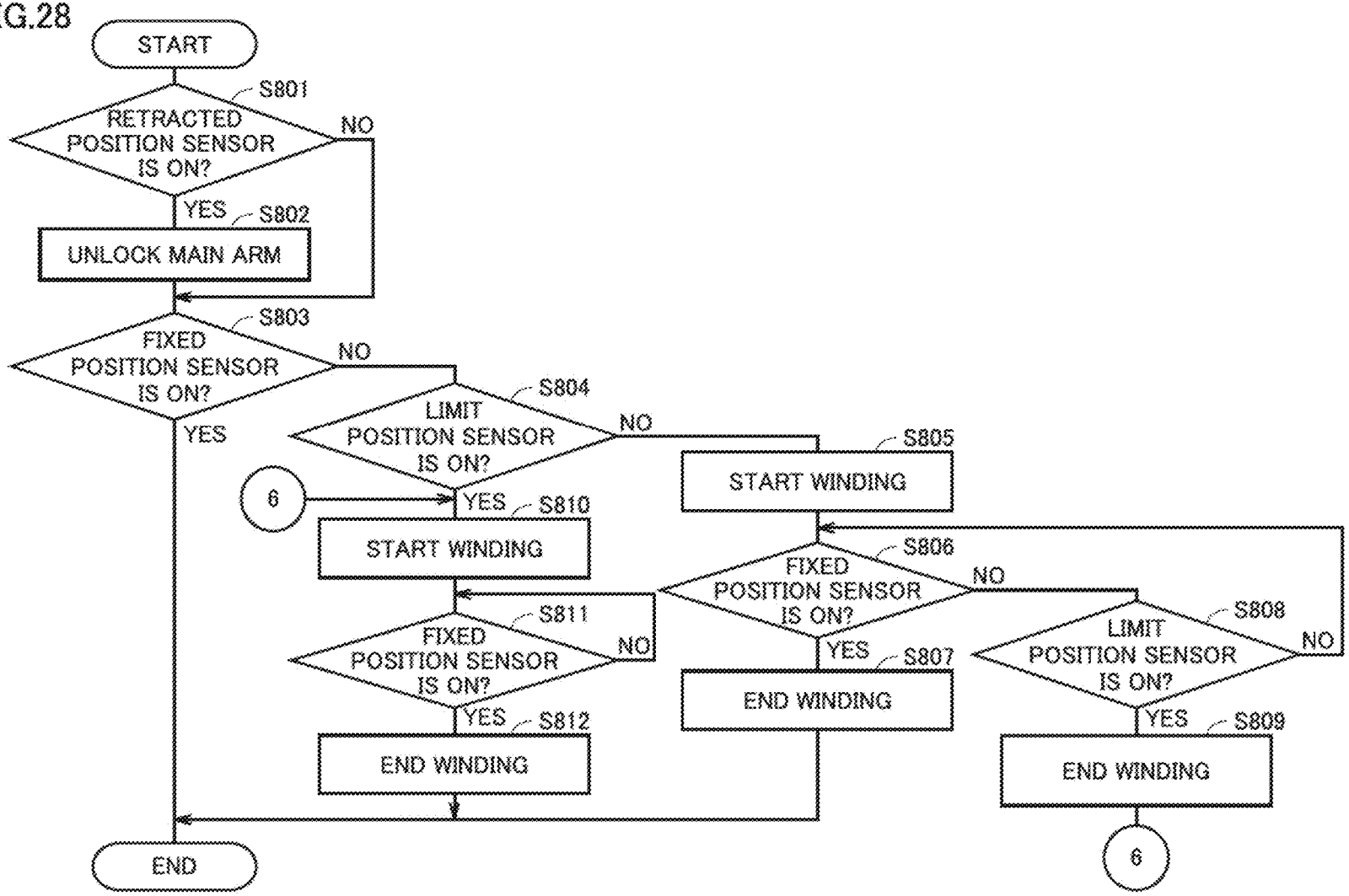
FIG. 28 is a flowchart illustrating another example of the fixed position return operation of the dancer roller after the mounting of the wound body.
Figure 29:
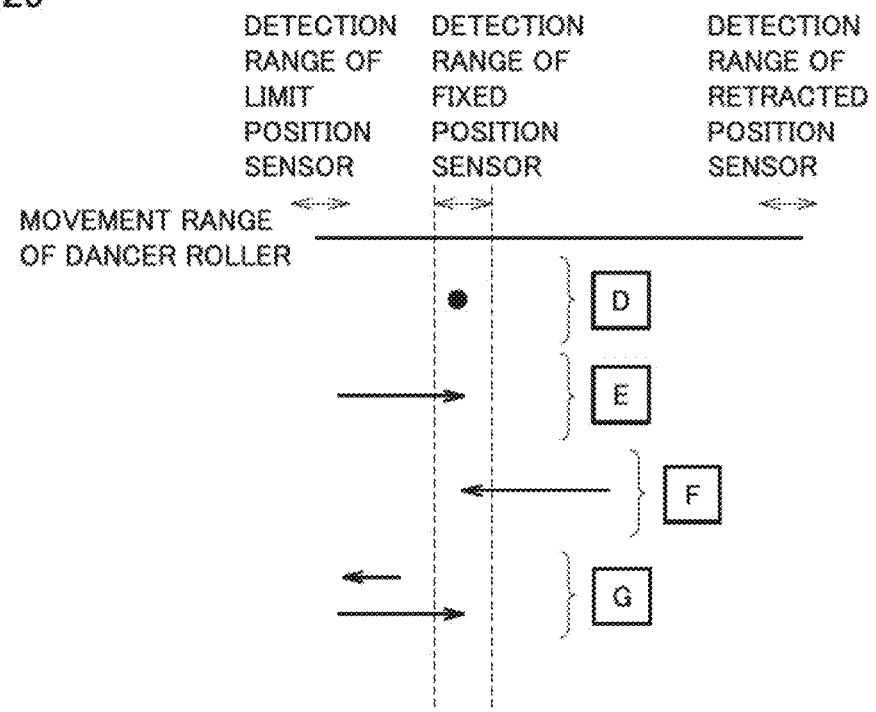
FIG. 29 is a schematic diagram illustrating the movement of the dancer roller while another example of the fixed position return operation of the dancer roller is executed after the mounting of the wound body.

FIG. 28 is a flowchart illustrating another example of the fixed position return operation of dancer roller 23 after the mounting of the wound body. FIG. 29 is a schematic diagram illustrating the movement of dancer roller 23 while another example of the fixed position return operation of dancer roller 23 is executed after the mounting of the wound body.

Another example of the fixed position return operation of dancer roller 23 after the mounting of the wound body in FIGS. 28 and 29 is different from the example in FIGS. 18 to 21 in the movement of dancer roller 23 when dancer roller 23 is stopped at the fixed position. In steps S801 to S809, the same pieces of processing as steps S201 to S209 in FIG. 18 are performed.

When it is detected in step S803 that fixed position sensor 28 is on (YES in step S803), the return operation is ended as it is without performing the winding and unwinding of packaging material 2.

When it is detected in step S804 that the limit position sensor 27 is on (YES in step S804), the processing proceeds to step S810, and the winding of packaging material 2 onto wound body 3 is started similarly to step S216 in FIG. 20. In step S811, the determination whether fixed position sensor 28 is on is repeated until it is detected that fixed position sensor 28 is turned on.

When it is detected that fixed position sensor 28 is turned on (YES in step S811), in step S812, the winding of packaging material 2 onto wound body 3 is ended. Instead of moving dancer roller 23 beyond the fixed position as in the example of FIG. 20, packaging material 2 is wound to stop dancer roller 23 at the fixed position.

When the unwinding of packaging material 2 from wound body 3 ends in step S809, the processing of winding packaging material 2 until dancer roller 23 reaches the fixed position in steps S810 to S812 is performed, and the return operation is ended.

In the example of FIG. 28, the pieces of the processing of steps S210 to S215, S218 in FIGS. 19 and 20 are omitted. As compared with FIG. 21, in FIG. 29, dancer roller 23 is not moved but is kept stopped at the fixed position at reference sign D, and dancer roller 23 is stopped at the time point when dancer roller 23 reaches the fixed position from the limit position as indicated by the arrows denoted by reference characters E, G, and the return operation is ended. As described above, the movement distance of dancer roller 23 during the return operation is shortened, so that the fixed position return operation can be ended in a shorter time.

Figure 30:
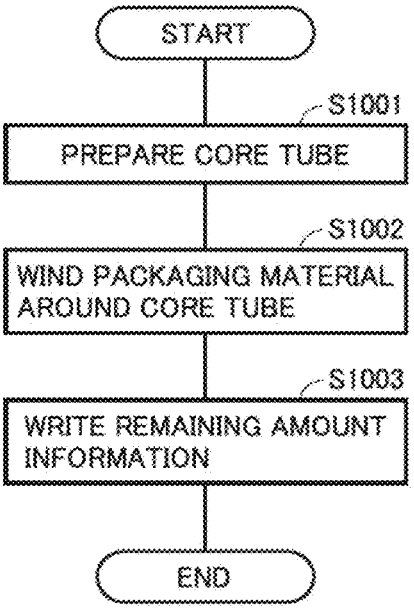
FIG. 30 is a flowchart illustrating a first example of a method for manufacturing the wound body.
Figure 31:
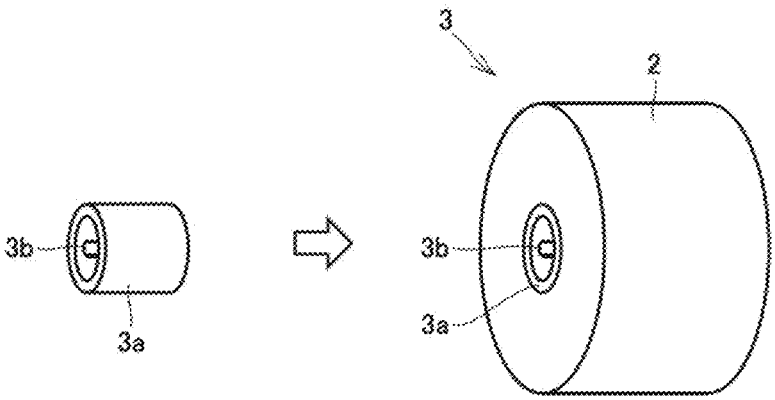
FIG. 31 is a view schematically illustrating the first example of the method for manufacturing the wound body.

A method for manufacturing wound body 3 will be described below. FIG. 30 is a flowchart illustrating a first method for manufacturing wound body 3. FIG. 31 is a view schematically illustrating a first example of the method for manufacturing wound body 3.

In the method for manufacturing wound body 3, core tube 3*a* is prepared as illustrated in FIG. 30 (step S1001). Core tube 3*a* including recording medium 3*b* described with reference to FIG. 2 is prepared as illustrated in FIG. 31. Alternatively, core tube 3*a* that does not include recording medium 3*b* may be prepared, for example, when recording medium 3*b* is attached to a winding start portion of packaging material 2.

Subsequently, packaging material 2 is wound around core tube 3*a* (step S1002). As illustrated in FIG. 31, packaging material 2 is wound around core tube 3*a* to form wound body 3.

Finally, the amount of packaging material 2 wound around core tube 3*a* in step S1002 is written in recording medium 3*b* as the remaining amount information indicating the remaining amount of packaging material 2 in wound body 3 (step S1003). As a result, when produced wound body 3 is mounted on packaging device 1, wound body 3 can be rotated at an appropriate rotation speed set based on the remaining amount information of packaging material 2 recorded in recording medium 3*b*. Accordingly, the time required for the return operation after the mounting of the wound body can be shortened. Then, the processing relating to the manufacturing of wound body 3 is ended ("end" in FIG. 30).

In step S1001, core tube 3*a* may be prepared after using up previously wound packaging material 2, and in step S1002, new packaging material 2 may be wound around core tube 3*a*. In this case, in step S1003, the amount of packaging material 2 wound around core tube 3*a* in step S1002 is written in recording medium 3*b* as the remaining amount information indicating the remaining amount of packaging material 2 in wound body 3, whereby the remaining amount information already recorded in recording medium 3*b* is overwritten and updated.

When the amount of packaging material 2 wound around core tube 3*a* is previously determined, the order of step S1002 and the order of step S1003 may be changed.

Figure 32:
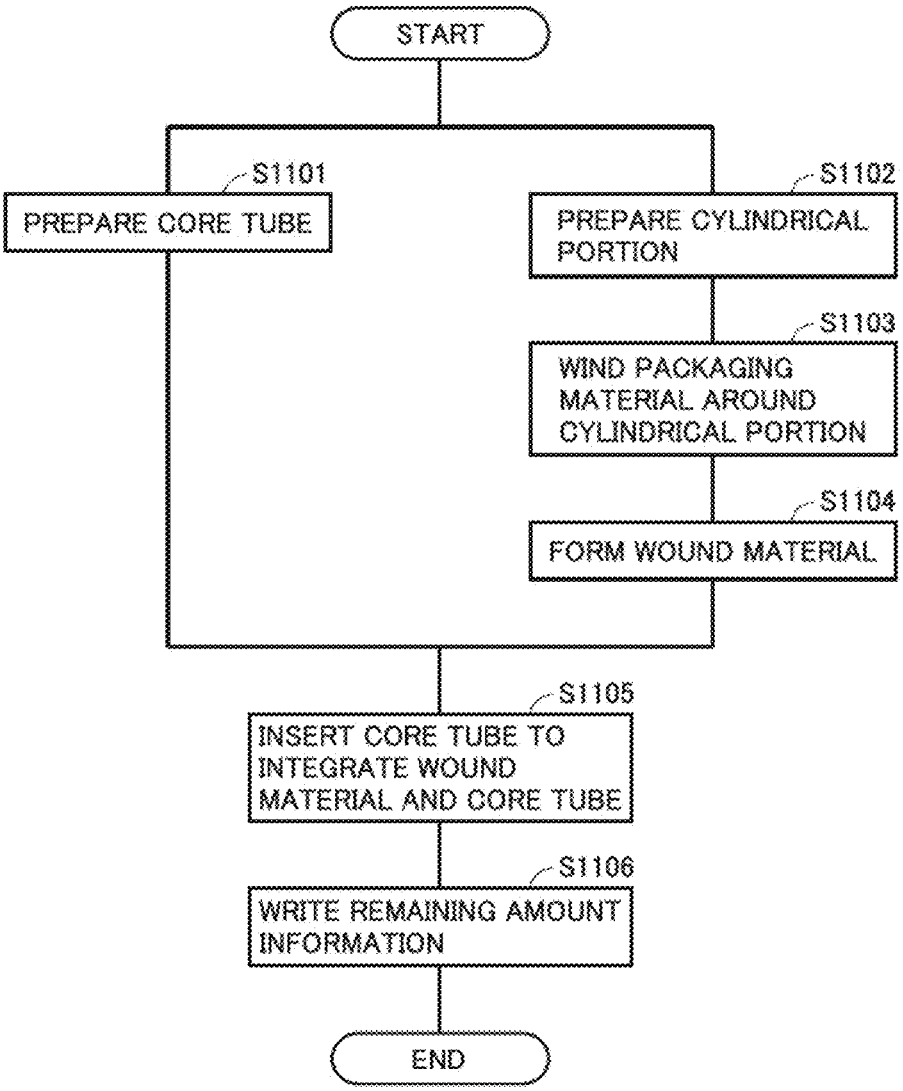
FIG. 32 is a flowchart illustrating a second example of the method for manufacturing the wound body.
Figure 33:
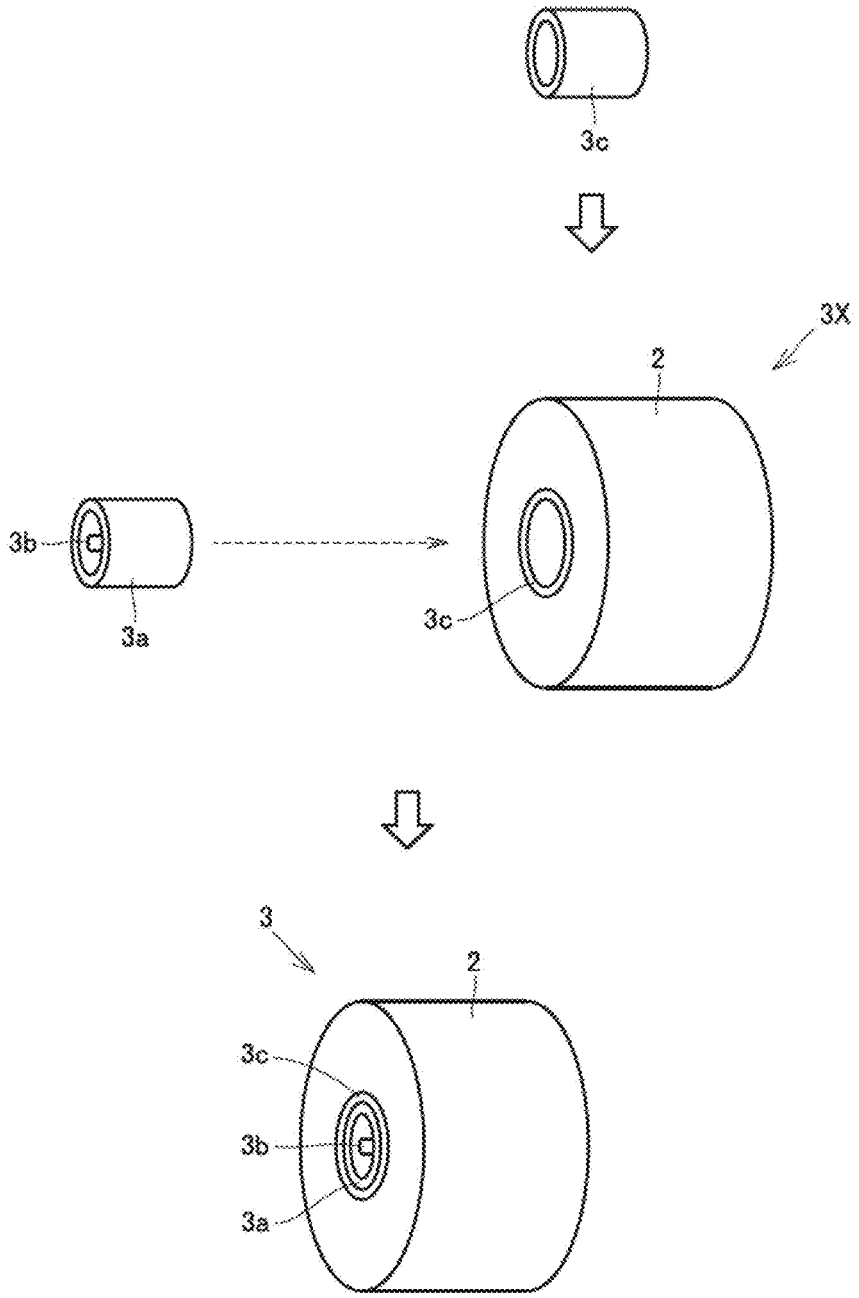
FIG. 33 is a view schematically illustrating the second example of the method for manufacturing the wound body.

FIG. 32 is a flowchart illustrating a second example of the method for manufacturing wound body 3. FIG. 33 is a view schematically illustrating a second example of the method for manufacturing wound body 3.

In the second example of the method for manufacturing wound body 3, core tube 3*a* is prepared as illustrated in FIG. 32 (step S1101). Core tube 3*a* including recording medium 3*b* described with reference to FIG. 2 is prepared as illustrated in FIG. 33. Alternatively, core tube 3*a* that does not include recording medium 3*b* may be prepared, for example, when recording medium 3*b* is attached to a winding start portion of packaging material 2.

On the other hand, a hollow cylindrical portion 3*c* is prepared (step S1102). Cylindrical portion 3*c* has an inner diameter slightly larger than an outer diameter of core tube 3*a*. Subsequently, packaging material 2 is wound around cylindrical portion 3*c* (step S1103) to form a wound material 3X (step S1104). The preparation of core tube 3*a* in step S1101 and the preparation of wound material 3X in steps S1102 to S1104 may be performed in parallel, or the other processing may be performed after either one of the pieces of processing. Wound material 3X may be formed at a location different from the installation location of the manufacturing equipment of wound body 3.

Subsequently, core tube 3*a* is inserted into cylindrical portion 3*c* to integrate the wound material 3X and core tube 3*a* (step S1105). For example, wound material 3X and core tube 3*a* can be integrated by inserting core tube 3*a* into a hollow portion of hollow cylindrical portion 3*c* in the state where a rubber band is wound around core tube 3*a*. In this manner, wound body 3 is produced.

Finally, the amount of packaging material 2 wound around cylindrical portion 3*c* in step S1103 is written in recording medium 3*b* as the remaining amount information indicating the remaining amount of packaging material 2 in wound body 3 (step S1106). As a result, when produced wound body 3 is mounted on packaging device 1, wound body 3 can be rotated at an appropriate rotation speed set based on the remaining amount information of packaging material 2 recorded in recording medium 3*b*. Accordingly, the time required for the return operation after the mounting of the wound body can be shortened. Then, the processing relating to the manufacturing of wound body 3 is ended ("end" in FIG. 32).

In step S1101, core tube 3*a* may be prepared after using up previously wound packaging material 2 and, in step S1105, core tube 3*a* and wound material 3X may be integrated. In this case, in step S1106, the amount of packaging material 2 wound around cylindrical portion 3*c* in step S1103 is written in recording medium 3*b* as the remaining amount information indicating the remaining amount of packaging material 2 in wound body 3, whereby the remaining amount information already recorded in recording medium 3*b* is overwritten and updated.

When the amount of packaging material 2 wound around cylindrical portion 3*c* is previously determined, the order of step S1105 and the order of step S1106 may be changed.

Although the embodiment of the present invention is described above, it should be considered that the disclosed embodiment is an example in all respects and not restrictive. The scope of the present invention is defined by not the description above, but the claims, and it is intended that all modifications within the meaning and scope of the claims and their equivalents are included in the present invention.

REFERENCE SIGNS LIST

1: packaging device
2: packaging material
3: wound body
3R: read and write unit
3*a*: core tube
3*b*: recording medium
5: supply unit
6: accommodation-part formation unit
6*h*: heater
6*m*: pressurizing motor
8: packaging material conveyance unit
8*m*: conveyance motor
9: packaging unit
10: packaging material supply unit
11: direction changing bar
12: cutting unit
13: discharging unit
15: frame
20: casing
20*a*: outer surface
21: mounting target unit
22: guide hole
23: dancer roller
24, 25: fixed roller
26: unlocking unit
27: limit position sensor
28: fixed position sensor
29: retracted position sensor
30: sensor support
31, 38, 45, 66: spring hook
35: unwinding and winding motor
40: main arm
41: first arm
42: second arm
43: bent portion
44: arm rotation shaft
46: return spring
47: lock pin
50: sub-arm
51: proximal end portion
52: distal end portion
53, 65: cylindrical portion
55: gear positioning plate
72: intermediate gear
73: intermediate pinion gear
74: roller gear
75: intermediate gear shaft
78: lock
90: spring hinge
101: drug supply device
102: housing
104: lower housing
108, 109: door
200: overall controller
201: packaging controller
DR: conveyance direction.

The invention claimed is:

1. A packaging device that packages an object to be packaged using a wound body, an elongated sheet-shaped packaging material being wound onto the wound body, the wound body including a recording medium that stores information, the information including a remaining amount information indicating a remaining amount of the packaging material in the wound body, wherein the packaging device comprises:

a drive unit configured to generate driving force rotating the wound body;

a conveyance unit configured to convey the packaging material unwound from the wound body along a conveyance path;

a tension applying unit including a displacement member that is displaceable in a direction intersecting the conveyance path, a fixed position of the displacement member being set, the tension applying unit being configured to apply tension to the packaging material when the displacement member presses the packaging material; and a fixed position sensor configured to detect that the displacement member is located at the fixed position, during a fixed position return operation of the displacement member after the wound body is mounted on the packaging device, the packaging device reads the remaining amount information stored in the recording medium of the wound body, sets a rotation speed of the wound body based on the read remaining amount information, and then drives the drive unit so as to rotate the wound body at the rotation speed set to move the displacement member to the fixed position, when a dispensing operation is started, the packaging device sets the rotation speed of the wound body based on the remaining amount information, the packaging device causes the conveyance unit to intermittently convey the packing material, and the packaging device causes the drive unit to drive the wound body such that the driving unit does not drive the wound body while the conveyance unit conveys the packaging material and the packaging material is unwound from the wound body until the fixed position sensor detects that the displacement member is located at the fixed position while the conveyance unit does not convey the packaging material, every time the drive unit drives the wound body, the packaging device measures a drive amount of the drive unit from the start of driving of the wound body by the drive unit to the detection by the fixed position sensor that the displacement member is located at the fixed position, and the packaging device determines the remaining amount of the packaging material in the wound body based on a measurement result, and the packaging device writes a determination result of the remaining amount of the packaging material in the recording medium as the remaining amount information.

2. The packaging device according to claim 1, wherein the packaging device further comprises a limit position sensor configured to detect that the displacement member is located at a limit position farther from the conveyance path than the fixed position, in the case the fixed position sensor does not detect the displacement member when the fixed position return operation is started, the packaging device unwinds the packaging material from the wound body until either the fixed position sensor or the limit position sensor detects the displacement member, and then, if the fixed position sensor detects the displacement member, the fixed position return operation of the displacement member is ended, and, if the limit position sensor detects the displacement member, the packaging device winds the packaging material onto the wound body until the fixed position sensor that detects the displacement member no longer detects the displacement member and then unwinds the packaging material from the wound body until the fixed position sensor detects the displacement member, and then the fixed position return operation of the displacement member is ended, and in the case the fixed position sensor detects the displacement member when the fixed position return operation is started, the packaging device winds the packaging material onto the wound body until the fixed position sensor no longer detects the displacement member and then unwinds the packaging material from the wound body until the fixed position sensor detects the displacement member, and then the fixed position return operation of the displacement member is ended.

3. A packaging device that packages an object to be packaged using a wound body, an elongated sheet-shaped packaging material being wound onto the wound body, the wound body including a recording medium that stores information, the information including a remaining amount information indicating a remaining amount of the packaging material in the wound body, wherein the packaging device comprises:

a drive unit configured to generate driving force rotating the wound body;

a conveyance unit configured to convey the packaging material unwound from the wound body along a conveyance path;

a tension applying unit including a displacement member that is displaceable in a direction intersecting the conveyance path, a fixed position of the displacement member being set, the tension applying unit being configured to apply tension to the packaging material when the displacement member presses the packaging material;

a fixed position sensor configured to detect that the displacement member is located at the fixed position; and a limit position sensor configured to detect that the displacement member is located at a limit position farther from the conveyance path than the fixed position, during a fixed position return operation of the displacement member after the wound body is mounted on the packaging device, the packaging device reads the remaining amount information stored in the recording medium of the wound body, sets a rotation speed of the wound body based on the read remaining amount information, and then drives the drive unit so as to rotate the wound body at the rotation speed set to move the displacement member to the fixed position, in the case the fixed position sensor does not detect the displacement member when the fixed position return operation is started, the packaging device unwinds the packaging material from the wound body until either the fixed position sensor or the limit position sensor detects the displacement member, and then, if the fixed position sensor detects the displacement member, the fixed position return operation of the displacement member is ended, and, if the limit position sensor detects the displacement member, the packaging device winds the packaging material onto the wound body until the fixed position sensor that detects the displacement member no longer detects the displacement member and then unwinds the packaging material from the wound body until the fixed position sensor detects the displacement member, and then the fixed position return operation of the displacement member is ended, and in the case the fixed position sensor detects the displacement member when the fixed position return operation is started, the packaging device winds the packaging material onto the wound body until the fixed position sensor no longer detects the displacement member and then unwinds the packaging material from the wound body until the fixed position sensor detects the displacement member, and then the fixed position return operation of the displacement member is ended.

* * * * *